US006778184B2

(12) United States Patent
Arita et al.

(10) Patent No.: US 6,778,184 B2
(45) Date of Patent: Aug. 17, 2004

(54) COLOR SIGNAL CORRECTION CIRCUIT, COLOR SIGNAL CORRECTION APPARATUS, COLOR SIGNAL CORRECTION METHOD, COLOR SIGNAL CORRECTION PROGRAM, AND DISPLAY APPARATUS

(75) Inventors: Kazuyuki Arita, Osaka (JP); Toshiya Aoki, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 29 days.

(21) Appl. No.: 10/202,880

(22) Filed: Jul. 26, 2002

(65) Prior Publication Data

US 2003/0020681 A1 Jan. 30, 2003

(30) Foreign Application Priority Data

Jul. 27, 2001 (JP) ..... 2001-227822

(51) Int. Cl.[7] ..... G09G 5/02

(52) U.S. Cl. ..... 345/589; 345/690; 345/22; 345/55; 358/518; 382/167

(58) Field of Search ..... 348/803, 624, 348/649; 358/518, 519, 520; 345/589, 597, 204, 613, 690, 614, 600, 593, 30, 72, 55, 22, 84, 83, 87, 88; 382/162–167

(56) References Cited

U.S. PATENT DOCUMENTS 5,898,415 A * 4/1999 Hansen et al. ..... 345/74.1
6,459,449 B1 * 10/2002 Juen ..... 348/223.1
2002/0122044 A1 * 9/2002 Deering ..... 345/597

* cited by examiner

*Primary Examiner*—Matthew C. Bella
*Assistant Examiner*—Wesner Sajous
(74) *Attorney, Agent, or Firm*—Birch, Stewart, Kolasch & Birch, LLP

(57) ABSTRACT

A color signal correction circuit for correcting a color signal which displays data on each pixel of a display apparatus, comprising: a color signal input section for inputting a color signal of N bits (N is a natural number); an addition section for adding second and third color signals corresponding to first and second adjacent pixels which are adjacent to the predetermined pixel to obtain addition value data; a first comparison section for subtracting duplicated color signal data, which is obtained by duplicating a first color signal corresponding to the predetermined pixel, from the addition value data to obtain a difference value; a LSB determination section for determining an LSB according to the difference value; and a color signal generation section for adding N higher order bits of the duplicated color signal data and the LSB, so as to generate a color signal of (N+1) bits.

13 Claims, 13 Drawing Sheets

X
Y
0
1
2
3
4
00h
01h
1Fh
3Fh

| 5bit | 6bit | 5bit | 6bit |
|---|---|---|---|
| 00h | 00h | 10h | 20h |
| 01h | 01h | 11h | 22h |
| 02h | 03h | 12h | 24h |
| 03h | 05h | 13h | 26h |
| 04h | 07h | 14h | 28h |
| 05h | 09h | 15h | 2Ah |
| 06h | 0Bh | 16h | 2Ch |
| 07h | 0Dh | 17h | 2Eh |
| 08h | 0Fh | 18h | 30h |
| 09h | 11h | 19h | 32h |
| 0Ah | 13h | 1Ah | 34h |
| 0Bh | 15h | 1Bh | 36h |
| 0Ch | 17h | 1Ch | 38h |
| 0Dh | 19h | 1Dh | 3Ah |
| 0Eh | 1Ah | 1Eh | 3Ch |
| 0Fh | 1Ch | 1Fh | 3Fh |

COLOR SIGNAL CORRECTION CIRCUIT, COLOR SIGNAL CORRECTION APPARATUS, COLOR SIGNAL CORRECTION METHOD, COLOR SIGNAL CORRECTION PROGRAM, AND DISPLAY APPARATUS

BACKGROUND OF THE INVENTION

1. Field of the Invention

The present invention relates to a field of drive control of a display apparatus. Specifically, the present invention relates to a color signal correction circuit, a color signal correction apparatus, a color signal correction method, and a color signal correction program, which are used for color signal correction in a display apparatus, and also relates to a display apparatus in which such color signal correction can be realized.

2. Description of the Related Art

The performance of a color display device used for an electronic apparatus or the like has been improving on a year-by-year basis. This trend is found not only in a large size display device incorporated in a liquid crystal TV, or the like, but also in a small size display device incorporated in a portable apparatus, such as a portable telephone, a portable game apparatus.

For example, in a conventional portable game apparatus, an image is displayed based on a low-resolution color-scale color signal, such as an animation image. However, recently, consumers have demanded high-quality color image displays, for example, of an image which looks like a natural picture where an object within a three-dimensional space is expressed with shadows. For the purpose of satisfying such a demand, it is necessary to provide some means to allow a color signal of higher-resolution color-scale (multiple color-scale levels) to be used in a display apparatus and a control circuit thereof.

Herein, a "color signal" refers to display data (color component data), such as an image displayed on pixels arranged in a matrix over a display apparatus, i.e., a color-scale representation value which is used for controlling the brightness of the pixels.

A conventional liquid crystal display apparatus has the following structure. FIG. 11 is a block diagram showing the structure of a conventional liquid crystal display apparatus. The liquid crystal display apparatus 101 includes: a liquid crystal display module 7; an external host system 8; and a system bus 9 which connects the liquid crystal display module 7 and the external host system 8. The liquid crystal display module 7 includes a liquid crystal display panel unit 11, a liquid crystal driving controller 12 (hereinafter "LCDC"), and a display memory 13. The external host system 8 includes a CPU 15; a system memory 16, and an I/O system 17.

For example, the liquid crystal display panel unit 11 includes: a TFT-type liquid crystal panel having pixels arranged in a matrix; a source driver for applying to a TFT source line of the liquid crystal panel a color-scale representation voltage, which is determined based on image display data generated for driving the liquid crystal panel; a gate driver for applying a scan control signal to a TFT gate line of the liquid crystal panel; and a liquid crystal driving voltage generation circuit for generating the color-scale representation voltage. In the case where the liquid crystal display panel unit 11 includes a STN-type liquid crystal panel, a segment driver and a common driver are used in place of the above source and gate drivers.

The LCDC 12 is a controller circuit which generates, under the control of the external host system 8, a control signal for controlling the source driver and the gate driver and an image display signal (data) to be supplied to the source driver. The LCDC 12 further includes: an interface section 21 for transmission of signals and data with the external host system 8 and the display memory 13; and a signal processing section 22 for reading image display data from the display memory 13 and generating a control signal to be supplied to the source driver in the liquid crystal display panel unit 11.

The LCDC 12 outputs: a transfer clock signal for transferring image display data; a source driver start pulse signal (horizontal synchronization signal) for controlling the start of transfer of the image display data based on the unit of a horizontal synchronization period; a gate driver start pulse signal (vertical synchronization signal) for controlling the start of scanning of a scan control signal; and a control signal, such as an alternating signal used for performing an alternating driving of the liquid crystal panel.

The external host system 8 is a commonly employed CPU system which transfers the image display data, which has been externally input through the I/O system 17, to the liquid crystal display panel unit 11, and controls the liquid crystal display module 7 via the system bus 9.

Recently employed liquid crystal display panel units include a TFT-type liquid crystal display panel unit which performs color-scale representation corresponding to image display data consisting of 18 bits in total. In this liquid crystal display panel unit, color image display data is data of 64 color-scale levels ($=2^6$) where 6 bits are allocated to each of R (red), G (green), and B (blue) pixels, each of which corresponds to 1 dot. The liquid crystal display module including this liquid crystal display panel unit is controlled using a CPU system which includes a commonly-employed, general purpose control processor, rather than a special purpose control processor, as an external host system. This is because the CPU system which includes the commonly-employed, general purpose control processor is less expensive, and can be used for various purposes.

The bit number of data which can be used in such a general purpose control processor is a multiple of 8 (i.e., 4), i.e., 8 bits, 16 bits, 24 bits, 32 bits, etc.

As of now, image display data consisting of 16 bits can express a color image by 65536 ($=2^{16}$) colors. In a color data pattern used for this image display data, a 5-6-5 format is generally employed. In the 5-6-5 format, as color-scale representation values, 5 bits are allocated to R, 6 bits to G, and 5 bits to B, so as to obtain image display data consisting of 16 bits in total.

In a TFT-type liquid crystal display panel unit, as described above, 6 bits are allocated as a color-scale representation value to each of R, G, and B, so as to obtain a uniform bit structure. That is, image display data to be processed consists of 18 bits in total.

Thus, in the liquid crystal display module 7 shown in FIG. 11, if image display data output from the external host system 8 and input to the LCDC 12 through the system bus 9 has a 16-bit structure, this data must be converted or corrected in the signal processing section 22 of the LCDC 12 into image display data consisting of 18 bits in total, where 6 bits are allocated as a color-scale representation value to each of R, G, and B.

Thus, in the signal processing section 22 of the LCDC 12, in order to obtain conformity between image display data consisting of 18 bits and image display data consisting of 16 bits, the image display data of 16 bits is subjected to color-scale correction such that 5-bit image data allocated to each of R-pixel and B-pixel is expanded to 6-bit image display data.

Conventional techniques of such color-scale correction are explained below:

(1) LSB (Least Significant Bit) Fixed Method

In this method, 1 bit is newly added as a least significant bit (LSB) to 5-bit image display data so as to obtain 6-bit data, and this new LSB is set to "1" or "0" by default.

(2) MSB (Most Significant Bit) Repetition Method

In this method, 1 bit is newly added as a least significant bit (LSB) to 5-bit image display data so as to obtain 6-bit data, and a value equal to data of the most significant bit is set as data of the least significant bit (LSB).

(3) Color-Scale Palette Method

In this method, the relationship between 5-bit image display data and 6-bit image display data is established in the form of a palette (also referred to as a "look up table (LUT)" or a "conversion table"). When certain image display data is input, image display data corresponding to the input image display data is output.

However, all of the above methods have a problem in color reproducibility (reproducibility of color-scale representation). Hereinafter, problems in each method are described, while considering an image example consisting of 8×8 pixels. Specifically, how to convert color component data in a color-scale correction process, where color component data (color-scale representation data) of 5-bit image display data is expanded so as to be 6-bit image display data, is described.

FIG. 12 shows an example of a display pattern of image display data (original image data) consisting of 5 bits, which is input to the LCDC 12. In FIG. 12, each circle represents a single pixel, and a value shown in each circle is a color component data value (color-scale representation data value) which corresponds to a pixel. This also applies to the display pattern diagram which will be described later. In this example, a color component is represented by a 5-bit value, and therefore, 32 ($2^5$=32) different values, i.e. "00h" to "1Fh" ("h" means that the value is represented by a hexadecimal number), can be displayed. In the example illustrated in FIG. 12, from a pixel at the left upper corner (coordinate (X=0, Y=0) in FIG. 12) to a pixel at the right lower corner (coordinate (X=7, Y=7)), 32 values from "00h" to "1Fh" are arranged such that the value of the pixels increases every two pixels.

In this example, value "00h" in 5-bit image display data or 6-bit image display data is data which corresponds to the darkest pixel in the display. Value "1Fh" in 5-bit image display data is data which corresponds to the brightest pixel in the display. Value "3Fh" in 6-bit image display data is data which corresponds to the brightest pixel in the display.

1. Color-Scale Correction Based on LSB Fixed Method

FIGS. 13 and 14 are display pattern diagrams obtained after the original image data of FIG. 12 has been subjected to color-scale correction based on the LSB fixed method. First, an example where "0" data is added to the LSB of color component data of the original image so that the color component data is color-scale-corrected (expanded) so as to be 6-bit data, is described. In the color-scale correction based on this method, the brightest value "1Fh" at coordinate (X=6, Y=7) in the 5-bit representation of FIG. 12 is converted into value "3Eh" in FIG. 13 (see hatched circles). However, as described above, "3Fh" is data corresponding to the brightest pixel in the display of 6-bit representation. Thus, in this conversion method, the brightest point which can be displayed in the display panel cannot be displayed.

Next, another case where color-scale correction is performed by adding "1" data to the LSB of the color component in the original image so that the image is expanded into a 6-bit representation, is described. In the color-scale correction based on this method, the darkest pixel value "00h" at coordinate (X=0, Y=0) in the 5-bit representation of the original image data shown in FIG. 12 is converted into value "01h" in FIG. 14 (see hatched circles). However, as described above, "00h" is data corresponding to the darkest pixel in the display of the 6-bit representation. Thus, in this conversion method, the darkest point which can be displayed in the display panel cannot be displayed.

Further, in the case of the LSB fixed method, as illustrated in FIGS. 13 and 14, in any of the above color-scale correction methods, the number of types of data which can be displayed after color-scale correction is only 32 (32 color-scale level display). That is, in any of the above methods, the 6-bit display performance of the display panel ($2^6$=64 color-scale level display) is not fully used.

2. Color-Scale Correction Based on MSB Repetition Method

FIG. 15 is a display pattern diagram obtained after the original image data of FIG. 12 has been subjected to color-scale correction based on the MSB repetition method. In this example, hatched pixels (at coordinates (X=7, Y=3) and (X=0, Y=4)) in FIG. 15 are considered. In the original image data (5-bit representation) in FIG. 12, these two pixels have consecutive values, 0Fh (01111) and 10h (10000). However, through color-scale correction (bit expansion conversion), these values are converted into largely discrete values, 1Eh (011110) and 21h (100001).

That is, significantly discrete points are caused in a gradual brightness variation pattern. This method is disadvantageous in that discrete points are caused in a gradual brightness variation, although the brightest and darkest points within the performance range of the display panel, which cannot be displayed using the LSB fixed method, can be displayed.

Further, even in the case of the MSB repetition method, the number of types of data which can be displayed after color-scale correction is only 32 (32 color-scale level display). That is, even in this method, the 6-bit display performance of the display panel is not fully used.

As described above, in the MSB repetition method is and the LSB fixed method, characteristics of an image are not considered when the image is subjected to a difference bit expansion process, and the expansion process is performed in a simple manner. Thus, in such methods, the display performance that the display panel originally has cannot be fully used.

3. Color-Scale Correction Based on Palette Method

FIG. 16A is a display pattern diagram obtained after the original image data of FIG. 12 has been subjected to color-scale correction based on the palette method. FIG. 16B is an example of a palette.

Consider color-scale correction where 5-bit image display data of pixels at coordinates (X=5, Y=7) and (X=6, Y=7) of the original image data (FIG. 12) are converted to 6-bit image display data of FIG. 16A. In FIG. 12, the values of image display data of these pixels are consecutive values. However, through color-scale correction, these values are converted into discrete values by the values set in the palette of FIG. 16B (i.e., the difference of the values of these pixels is largely increased after conversion in comparison to that of other adjoining pixels). That is, significantly discrete points are caused in a gradual brightness variation pattern.

The palette method is characterized in that discrete points can be freely selected, whereas such selection cannot be performed in the MSB repetition method. However, even in this method, the number of types of data included in the palette is only 32. That is, even in this method, the 6-bit display performance of the display panel cannot be fully utilized.

Even though the color-scale palette method has flexibility such that the values in the palette can be freely changed, and therefore, a user can freely set color-scale expression parameters, such as γ-correction, or the like, once the values have been set, such a setting of values is applied to all displays. Thus, it is necessary to set the palette according to the type of an image to be displayed, e.g., a natural image, a graphic image, an animation image, etc. Accordingly, such an additional setting labor imposes a burden on a user.
Even if the palette is set according to the type of an image to be displayed, the above-described problem is not eliminated, i.e., the display performance of the display panel cannot be fully utilized.

Thus, as described above, the above conventional techniques bear a problem that high-quality color image data which fully utilizes the high color-scale display performance of a display apparatus cannot be obtained without imposing a burden on a user or without being dependent on an image to be displayed.

SUMMARY OF THE INVENTION

The present invention includes the following structures as means for solving the above problems.

(1) There is provided a color signal correction circuit for correcting a color signal which displays data on each pixel of a display apparatus arranged in a matrix, comprising: a color signal input section for inputting a color signal of N bits (N is a natural number); a color signal data storage section for storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input section; an addition section for adding the second color signal and the third color signal to obtain addition value data; a duplication section for duplicating the first color signal to obtain duplicated color signal data; a first comparison section for subtracting the duplicated color signal data from the addition value data to obtain a difference value; a first LSB determination section for determining an LSB according to the difference value; and a color signal generation section for adding N higher order bits of the duplicated color signal data and the LSB, so as to generate a color signal of (N+1) bits.

In the color signal correction circuit having such a structure, in order to correct a color signal which displays data on each pixel of the display apparatus arranged in a matrix, the color signal data storage section stores a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are included in a color signal of N bits input to the color signal input section. The addition section adds the second color signal and the third color signal to obtain addition value data. The duplication section duplicates the first color signal to obtain duplicated color signal data. The first comparison section subtracts the duplicated color signal data from the addition value data to obtain a difference value. The color signal generation section adds the LSB determined by the first LSB determination section according to the difference value and N higher order bits of the duplicated color signal data, so as to generate a color signal of (N+1) bits.

Thus, color signal correction is performed on a color component of a color image using a simple circuit so as to obtain a color quality with smooth gradation, whereby the color resolution of the color image can be improved. A value of a low-order bit, which is rounded down in unexpanded data, is subjected to an arithmetic operation and comparison processing, and restored by estimation, As a result, image display with a high quality can be realized. It should be noted that "LSB" is an abbreviation of a Least Significant Bit.

(2) If the difference value is equal to or smaller than 0, the first LSB determination section sets the LSB to 0; and if the difference value is greater than 0, the first LSB determination section sets the LSB to 1.

In such a structure, if the difference value between the addition value data obtained by adding the second and third color signals by the addition means, and the duplicated color signal data obtained by duplicating the first color signal by the duplication section, is equal to or smaller than 0, the first LSB determination section sets the LSB to 0; and if the difference value is greater than 0, the first LSB determination section sets the LSB to 1. Thus, color signal correction can be performed while achieving high color reproducibility.

(3) There are provided a second comparison section for comparing the difference value with a predetermined reference value, and a second LSB determination section for setting the LSB to 0 when the difference value is equal to or greater than the predetermined reference value, and for setting the LSB to 1 when the difference value is smaller than the predetermined reference value.

In the color signal correction circuit having such a structure, the difference value between the addition value data obtained by adding the second and third color signals by the addition means and the duplicated color signal data obtained by duplicating the first color signal by the duplication section is compared with a predetermined reference value. The second LSB determination section sets the LSB to 0 when the difference value is equal to or greater than the predetermined reference value, and sets the LSB to 1 when the difference value is smaller than the predetermined reference value. Thus, color signal correction can be performed on an image having a sharp outline without blurring the outline, and the color resolution of the image can be improved.

(4) There is provided a selection section for selecting one of the LSB determined by the first LSB determination section and the LSB determined by the second LSB determination section.

In the color signal correction circuit having such a structure, a selection section selects one of the LSB determined by the first LSB determination section and the LSB determined by the second LSB determination section. With such an arrangement, the LSB can be selected according to the type of an image on which color signal correction is to be performed.

(5) The difference value obtained when an increase in the percentage of the number of corrected pixels stops or almost stops is used as the predetermined reference value.

In the color signal correction circuit having such a structure, the difference value obtained when an increase in the percentage of the number of corrected pixels stops or almost stops is used as the predetermined reference value which is to be compared with the difference value by the second comparison section. Thus, optimum color signal correction can be performed on various types of images, and the color resolution of the image can be improved. (6) The predetermined reference value is 7.

In this structure, the predetermined reference value which is to be compared with the difference value by the second comparison section is 7. Thus, even in the case where color signal correction is performed on an image representing an outline portion of a face or character which includes a portion where the brightness varies in a discrete manner, the outline portion is not blurred, and image correction can be performed while maintaining the sharp outline.

(7) There is provided a color signal correction apparatus comprising the color signal correction circuit of any of above paragraphs (1) to (6), wherein in color image data including a plurality of types of color signals, correction is performed on at least one of the plurality of types of color signals.

A color signal correction apparatus having such a structure includes the color signal correction circuit of any of above paragraphs (1) to (6), wherein at least a correction process is performed on one of a plurality of types of color signals. Thus, there is provided a color signal correction apparatus which performs color signal correction on a color component of a color image using a simple circuit so as to obtain a color quality with no uneven gradation, whereby the color resolution of the color image can be improved.

(8) The plurality of types of color signals include color signals for R-, G-, B-pixels.

In this structure, the plurality of types of color signals, which are input as color image data for each of the R-, G-, B-pixels, are corrected. Thus, the color resolution of the color image can be improved for each of the color components of the color image.

(9) There is provided a color signal correction method for correcting a color signal which displays data on each pixel of a display apparatus arranged in a matrix, comprising: a color signal input step of inputting a color signal of N bits (N is a natural number); a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step; an addition value calculation step of adding the second color signal and the third color signal to obtain addition value data; a duplicated value calculation step of duplicating the first color signal to obtain duplicated color signal data; a first comparison step of obtaining a difference value between the addition value data and the duplicated color signal data; a first LSB determination step of determining an LSB according to the comparison result of the first comparison step; and a color signal generation step of adding N higher order bits of the duplicated color signal data and the LSB, so as to generate a color signal of (N+1) bits.

In this structure, a color signal is corrected by performing the following steps: a color signal input step of inputting a color signal of N bits (N is a natural number); a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step; an addition value calculation step of adding the second color signal and the third color signal to obtain addition value data; a duplicated value calculation step of duplicating the first color signal to obtain duplicated color signal data; a first comparison step of obtaining a difference value between the addition value data and the duplicated color signal data; a first LSB determination step of determining an LSB according to the comparison result of the first comparison step; and a color signal generation step of adding N higher order bits of the duplicated color signal data and the LSB, so as to generate a color signal of (N+1) bits.

Thus, there is provided a method which can perform color signal correction on a color component of a color image so as to obtain a color quality with no uneven gradation, whereby the color resolution of the color image can be improved.

(10) There is provided a color signal correction program which instructs a computer to execute the following steps: a color signal input step of inputting a color signal of N bits (N is a natural number); a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step; an addition value calculation step of adding the second color signal and the third color signal to obtain addition value data; a duplicated value calculation step of duplicating the first color signal to obtain duplicated color signal data; a first comparison step of obtaining a difference value between the addition value data and the duplicated color signal data; a first LSB determination step of determining an LSB according to the comparison result of the first comparison step; and a color signal generation step of adding N higher order bits of the duplicated color signal data and the LSB, so as to generate a color signal of (N+1) bits.

In this structure, a color signal is corrected by allowing a computer to execute a program including the following steps: a color signal input step of inputting a color signal of N bits (N is a natural number); a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step; an addition value calculation step of adding the second color signal and the third color signal to obtain addition value data; a duplicated value calculation step of duplicating the first color signal to obtain duplicated color signal data; a first comparison step of obtaining a difference value between the addition value data and the duplicated color signal data; a first LSB determination step of determining an LSB according to the comparison result of the first comparison step; and a color signal generation step of adding N higher order bits of the duplicated color signal data and the LSB, so as to generate a color signal of (N+1) bits.

Thus, there is provided a color signal correction program which can perform color signal correction on a color component of a color image so as to obtain a color quality with no uneven gradation, whereby the color resolution of the color image can be improved.

(11) There is provided a display apparatus comprising the color signal correction circuit of any of above paragraphs (1) to (6) or the color signal correction apparatus of above paragraph (7) or (8).

In this structure, a display apparatus includes the color signal correction circuit of any of above sections (1) to (6), or the color signal correction apparatus of above section (7) or (8). Thus, the display apparatus can perform color signal correction on a color component of a color image using a simple circuit so as to obtain a color quality with no uneven gradation, whereby the color resolution of the color image can be improved.

(12) There is provided a display apparatus comprising a control section for executing the color signal correction program of above section (10).

A display apparatus having such a structure includes a control section for executing the color signal correction program of above section (10). Thus, the display apparatus can execute the color signal correction program to perform color signal correction on a color component of a color image using a simple circuit so as to obtain a color quality with no uneven gradation, whereby the color resolution of the color image can be improved.

Thus, the invention described herein makes possible the advantages of (i) providing a color signal correction circuit, a color signal correction apparatus, a color signal correction method, a color signal correction program, and a display apparatus, which can perform correction of color image data in a manner optimum to a gradually-varying color image data characteristic; and (ii) providing a color signal correction circuit, a color signal correction apparatus, a color signal correction method, a color signal correction program, and a display apparatus, which can perform correction of color image data in a manner optimum to a sharp color image data characteristic which varies in a non-gradual manner, e.g., a characteristic seen in specific image data, such as character data.

These and other advantages of the present invention will become apparent to those skilled in the art upon reading and understanding the following detailed description with reference to the accompanying figures.

DESCRIPTION OF THE PREFERRED EMBODIMENTS

Hereinafter, an embodiment of the present invention is described while considering an exemplary color-scale correction process where, for example, in a liquid crystal display apparatus, 16-bit image display data of a 5-6-5 format (R: 5 bits, C: 6 bits, B: 5 bits) is expansion-converted into 18-bit image display data (6 bits for each of R, G, and B).

In the embodiment, identical means is required for each of color-scale correction of R- and B-components.

Figure 1:
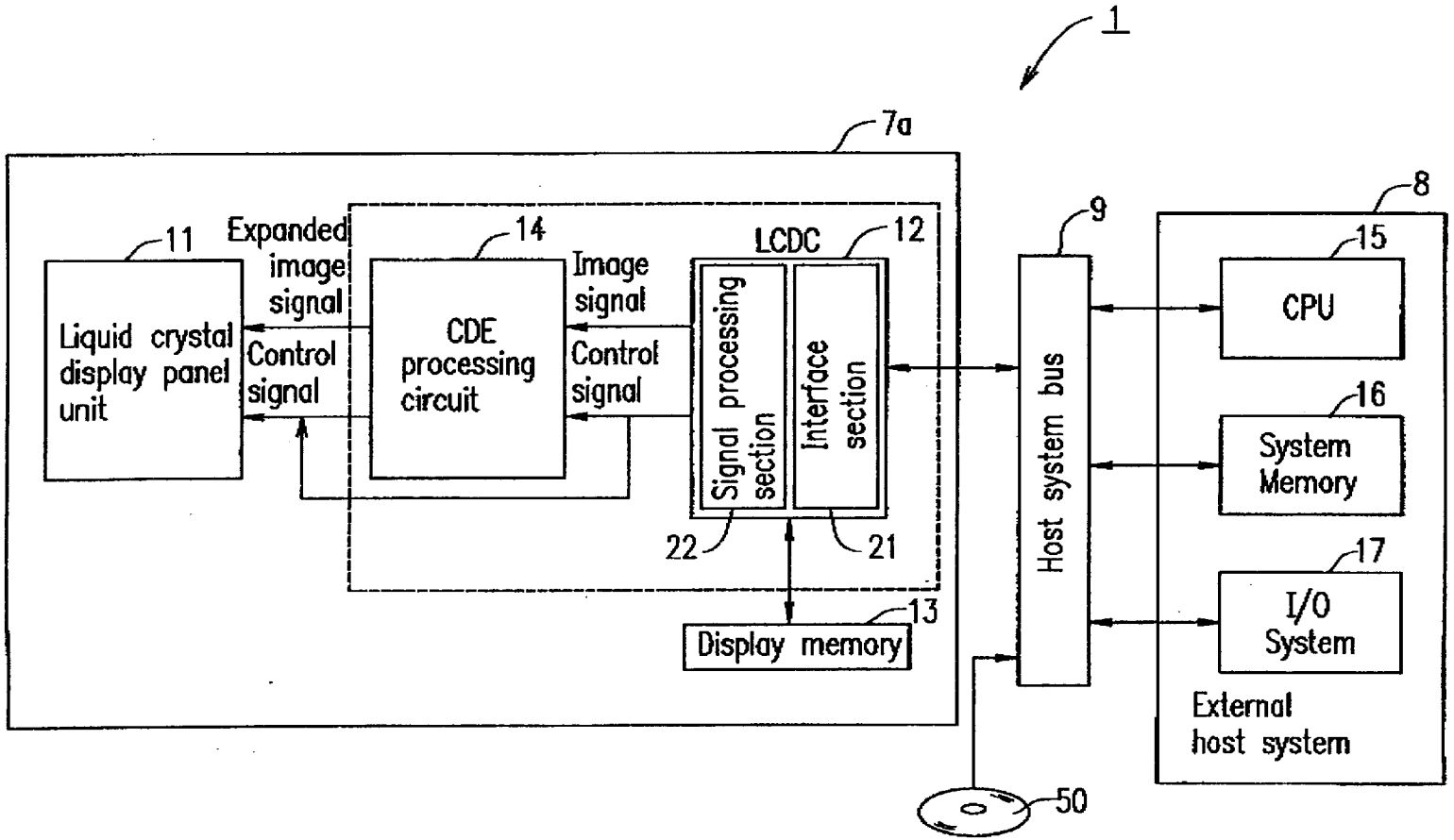
FIG. 1 is a block diagram showing an example of a system structure of a liquid crystal display apparatus according to an embodiment of the present invention.
Figure 11:
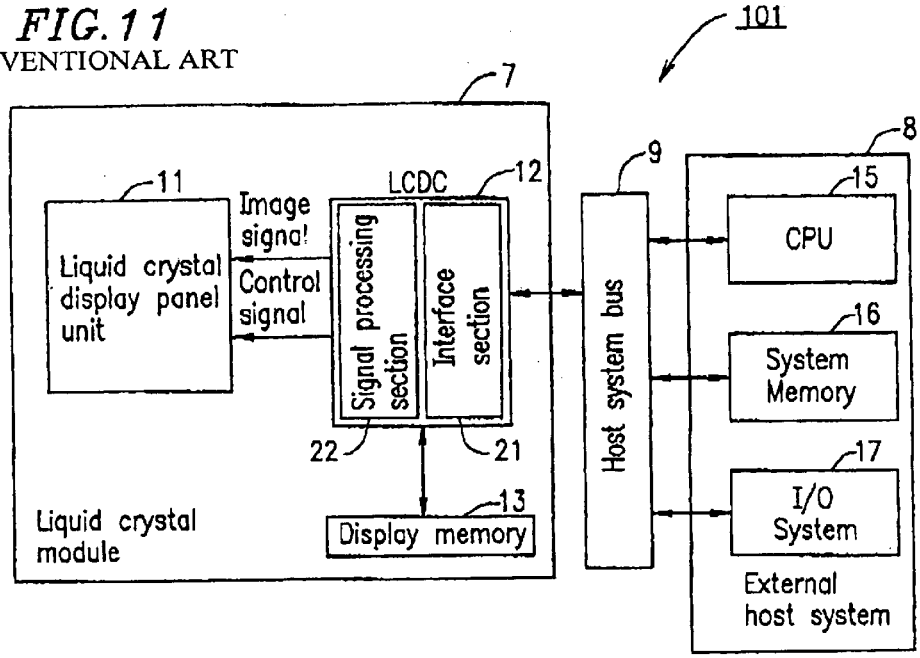
FIG. 11 CONVENTIONAL ART
FIG. 11 is a block diagram showing the structure of a conventional liquid crystal display apparatus.

First, a structure of a liquid crystal display apparatus of the present invention is described. FIG. 1 is a block diagram showing an example of a system structure of a liquid crystal display apparatus according to an embodiment of the present invention. The liquid crystal display apparatus 1 further includes a CDE processing circuit 14 in addition to the components of the liquid crystal display apparatus 101 shown in FIG. 11. In FIG. 1, like elements are indicated by like reference numerals used in FIG. 11.

"CDE processing" refers to Color Depth Expander processing, which corresponds to color-scale correction (expansion conversion) processing of the present invention.

The liquid crystal display apparatus 1 includes: a liquid crystal display module 7*a*; an external host system 8; and a system bus 9 which connects the liquid crystal display module 7*a* and the external host system 8. The liquid crystal display module 7*a* includes a liquid crystal display panel unit 11, an LCDC 12, a display memory 13, and the CDE processing circuit 14. The external host system 8 includes a CPU 15; a system memory 16, and an I/O system 17.

For example, the liquid crystal display panel unit 11 includes: a TFT-type liquid crystal panel having pixels arranged in a matrix; a source driver for applying a color-scale representation voltage, which is determined based on image display data generated for driving the liquid crystal panel, to a TFT source line of the liquid crystal panel; a gate driver for applying a scan control signal to a TFT gate line of the liquid crystal panel; and a liquid crystal driving voltage generation circuit for generating the color-scale representation voltage. In the case where the liquid crystal display panel unit 11 includes a STN-type liquid crystal panel, a segment driver and a common driver are used in place of the above source and gate drivers.

The LCDC 12 is a controller circuit which generates, under the control of the external host system 8, a control signal for controlling the source driver and the gate driver and image display data to be supplied to the source driver. The LCDC 12 further includes: an interface section 21 for transmission of signals and data with the external host system 8 and the display memory 13; and a signal processing section 22 for reading image display data from the display memory 13 and generating a control signal to be supplied to the source driver in the liquid crystal display panel unit 11.

The LCDC 12 outputs: a transfer clock signal for transferring image display data; a source driver start pulse signal (horizontal synchronization signal) for controlling the start of transfer of the image display data based on the unit of a horizontal synchronization period; a gate driver start pulse signal (vertical synchronization signal) for controlling the start of scanning of a scan control signal; and a control signal, such as an alternating signal used for performing an alternating driving of the liquid crystal panel. These control signals may be output to the liquid crystal display panel unit 11 through the CDE processing circuit 14 at a timing adjusted by the CDE processing circuit 14.

The control signals output from the LCDC 12 to the CDE processing circuit 14 include a transfer clock for transferring image display data, a latch signal used for exchanging data at a predetermined timing when a calculation is performed using image display data in the CDE processing circuit 14, or the like.

The CDE processing circuit 14 performs color-scale correction on a color signal of an image received from the LCDC 12 by CDE processing, and output the color-scale-corrected image signal to the liquid crystal display panel unit 11. The CDE processing circuit 14 is provided between the signal processing section 22 of the LCDC 12 and the liquid crystal display panel unit 11.

The external host system 8 is a commonly employed CPU system which transfers the image display data, which has been externally input through the I/O system 17, to the liquid crystal display panel unit 11, and controls the liquid crystal display module 7*a* via the system bus 9.

In the example illustrated in FIG. 1, the CDE processing circuit 14 is provided between the liquid crystal display panel unit 11 and the LCDC 12. However, this example is employed for convenience of comparison with the structure of the conventional liquid crystal display apparatus 101. Thus, the present invention is not limited to the structure of FIG. 1. For example, the CDE processing circuit 14 may be incorporated in the signal processing section 22 of the LCDC 12, so as to establish the CDE processing circuit 14 and the signal processing section 22 on a single chip.

The LCDC including the CDE processing circuit may be realized in the form of a separate circuit as shown in FIG. 1. Alternatively, the LCDC may be formed by a microprocessor which can perform both general processing and CDE processing. In this case, a flow program of the CDE processing, which will be described later, is stored in the system memory 16 of the external host system 8, and the LCDC 12 executes the program read from the stored program, whereby the CDE processing function of the present invention can be realized.

Figure 2A:
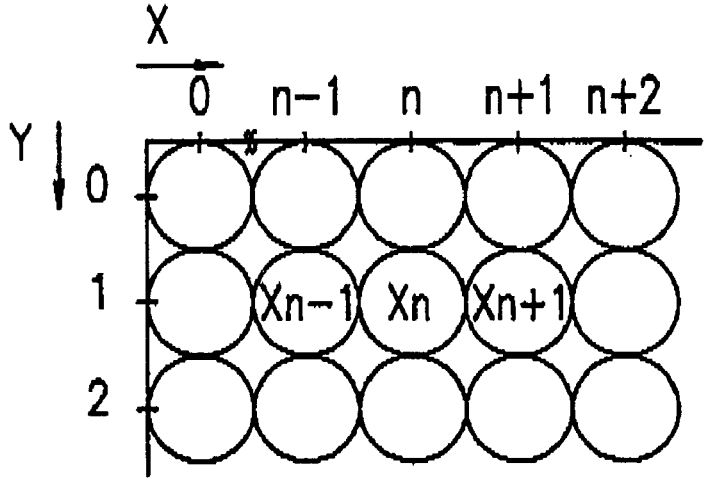
FIG. 2 is a display pattern diagram which shows positions and image data of pixels of image display data (original image data).
Figure 2B:
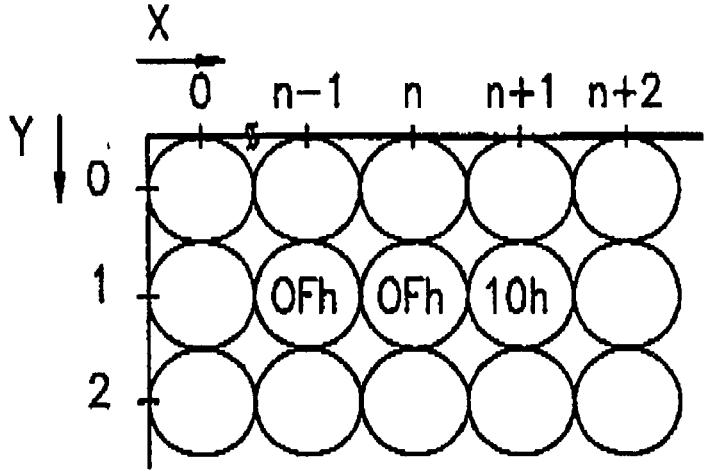

Next, the CDE processing performed in the CDE processing circuit incorporated in the liquid crystal display apparatus of the present invention is described. FIG. 2A is a display pattern diagram which shows positions of pixels of image display data (original image data). FIG. 2B is a display pattern diagram which shows image data of the pixels of the image display data (original image data). As shown in FIGS. 2A and 2B, a pixel Xn whose Y-coordinate is 1 (Y=1) has a value of "0Fh" as image display data (5 bits) which is a first color signal. A pixel Xn−1 adjacent to the pixel Xn (first adjacent pixel) has a value of "0Fh" as image display data which is a second color signal. A pixel Xn+1 adjacent to the pixel Xn and opposite to the pixel Xn−1 with respect to the pixel Xn (third adjacent pixel) has a value of "10h" as image display data which is a third color signal.

Figure 3:
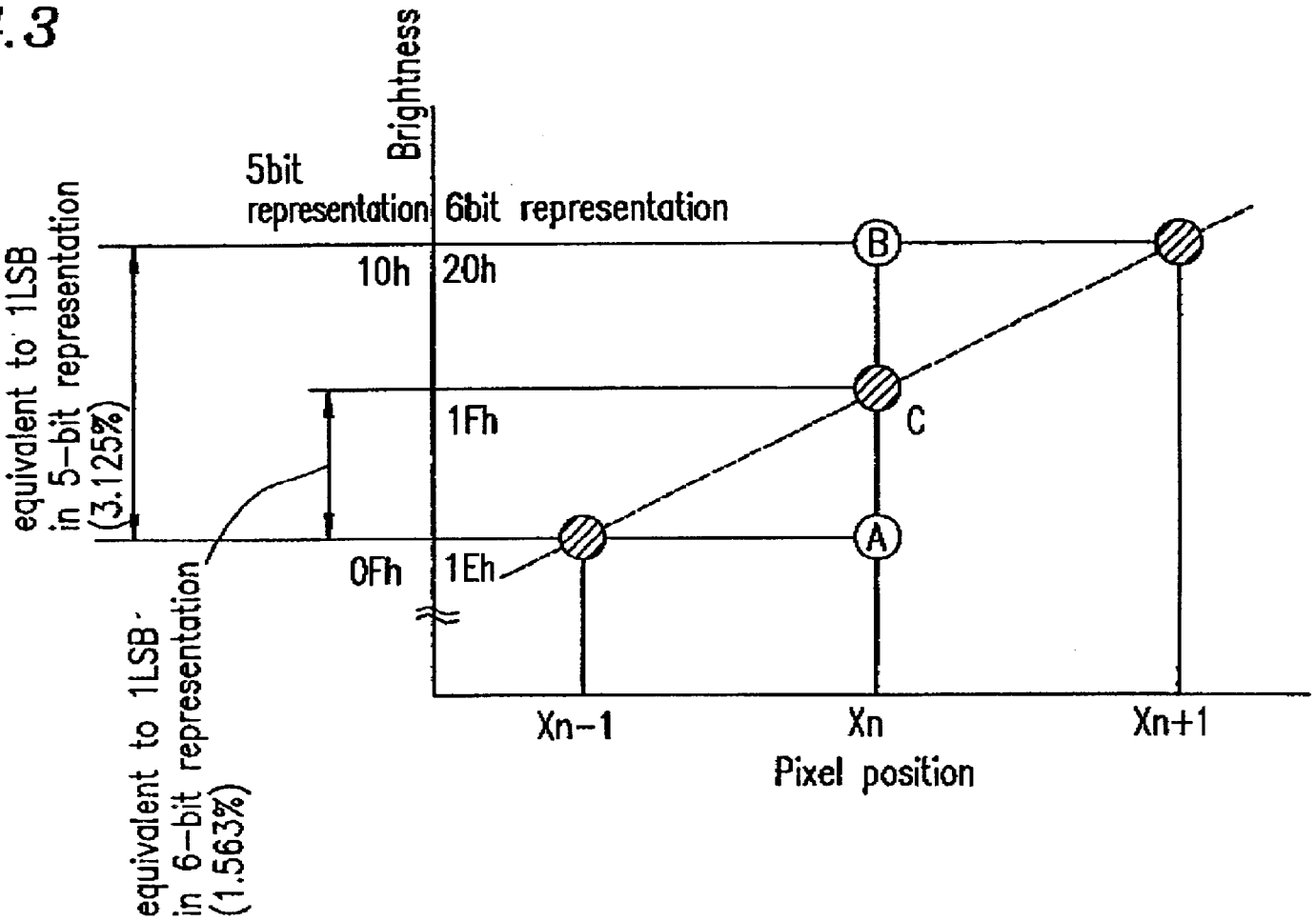
FIG. 3 illustrates a principle for obtaining a corrected value of a target pixel from data of two neighboring pixels.

Herein, assume that the color-scale representation value (hereinafter, simply referred to as a "value") of the pixel Xn−1 is A, the value of the pixel Xn+1 is B, the true value of the pixel Xn is Z. The relationship about the position and brightness between the pixel Xn−1 and the pixel Xn+1 is shown in FIG. 3. FIG. 3 illustrates a principle for obtaining a corrected value of a target pixel from data of two neighboring pixels.

In FIG. 2B, the value of the pixel Xn is equal to that of the pixel Xn−1. However, in the case where an image is displayed with a sufficiently smooth color-scale representation, it is natural to consider that the true value of the pixel Xn is an intermediate value between the value of the pixel Xn−1 and the value of the pixel Xn+1. That is, the true value Z of the pixel Xn is rounded, i.e., rounded up or rounded down, when the brightness of the pixel Xn is quantized into an image display data (5-bit) value, resulting in the value A or B as shown in FIG. 3.

However, in an actual quantization process, rounding-up is not performed in general, because in the case where round-up processing is performed, round-up processing performed for the LSB influences high-order bits, and the processing time required for sequential processing of the high-order bits is increased. Further, in the worst case, the MSB is varied so that an overflow state occurs, and in such a case, troubles occur in the processing, or the processing becomes complicated. For such reasons, round-down processing is generally performed in a quantization process.

In view of the above, it is estimated that, in the case where the brightness of a displayed image gradually increases from left to right, the true value Z of the pixel Xn is within the range of $A \leqq Z < B$, and the value of the pixel Xn is rounded down to A (5 bits) through quantization.

In order to obtain the true value Z of the pixel Xn, the following process is performed. The average value of the color-scale representation values of the pixels adjacent to the pixel Xn, i.e., the previous pixel Xn−1 and the subsequent pixel Xn+1, is calculated, and a difference value Δ between the average value and the value of the pixel Xn to be corrected is obtained. In an actual case, however, by shifting the value of the pixel Xn (5-bit value [Bit4 (MSB), Bit3, Bit2, Bit1, Bit0 (LSB)]) upwardly by 1 bit, a twofold value of the value of the pixel Xn (6-bit value [Bit5 (MSB), Bit4, Bit3, Bit2, Bit1]) can be readily obtained. Thus, the value of the pixel Xn−1 and the value of the pixel Xn+1 are summed up, and a difference value Δ between the sum and the twofold value of the value of the pixel Xn is obtained. The difference value Δ is represented by following expression 1:

$$\Delta=(Xn-1+Xn+1)-2Xn \qquad \text{(expression 1)}$$

In the case where the value of the pixel Xn is A, and the average value between the value of the pixel Xn−1 and the value of the pixel Xn+1 is greater than value A (Δ>0), it is determined that the value of the pixel Xn was rounded down. In such a case, 1 is added to the twofold value of the value of the pixel Xn. That is, Bit0(LSB)=1. As a result, the value of the pixel Xn is corrected so as to be value C.

In the case where the value of the pixel Xn is A, and the average value between the value of the pixel Xn−1 and the value of the pixel Xn+1 is equal to or smaller than value A ($\Delta \leqq 0$), 0 is added to the twofold value of the value of the pixel Xn. That is, Bit0(LSB)=0. That is, color-scale correction is performed while performing expansion conversion is such that, if the value Z of the pixel Xn is within the range of $A \leqq Z < C$, the value Z is rounded down to value A, and if the value Z of the pixel Xn is within the range of $C \leqq Z < B$, the value Z is rounded down to value C. This rule is the same as that described above such that the value Z of the pixel Xn is rounded down to value A if it is within the range of $A \leqq Z < B$. Thus, color-scale correction can be performed while considering image display data which has already been rounded down, such that an expansion conversion error with respect to a true value is reduced. Therefore, a continuous and natural color-scale representation can be achieved.

The principles of the CDE processing in the case where continuous color-scale representation is performed on adjoining pixels have been described above. However, the present invention is not limited to the above example. The color-scale correction of the present invention can be performed by expansion-converting a value of a pixel of N bits into a value of a pixel of (N+1) bits.

Figure 4:
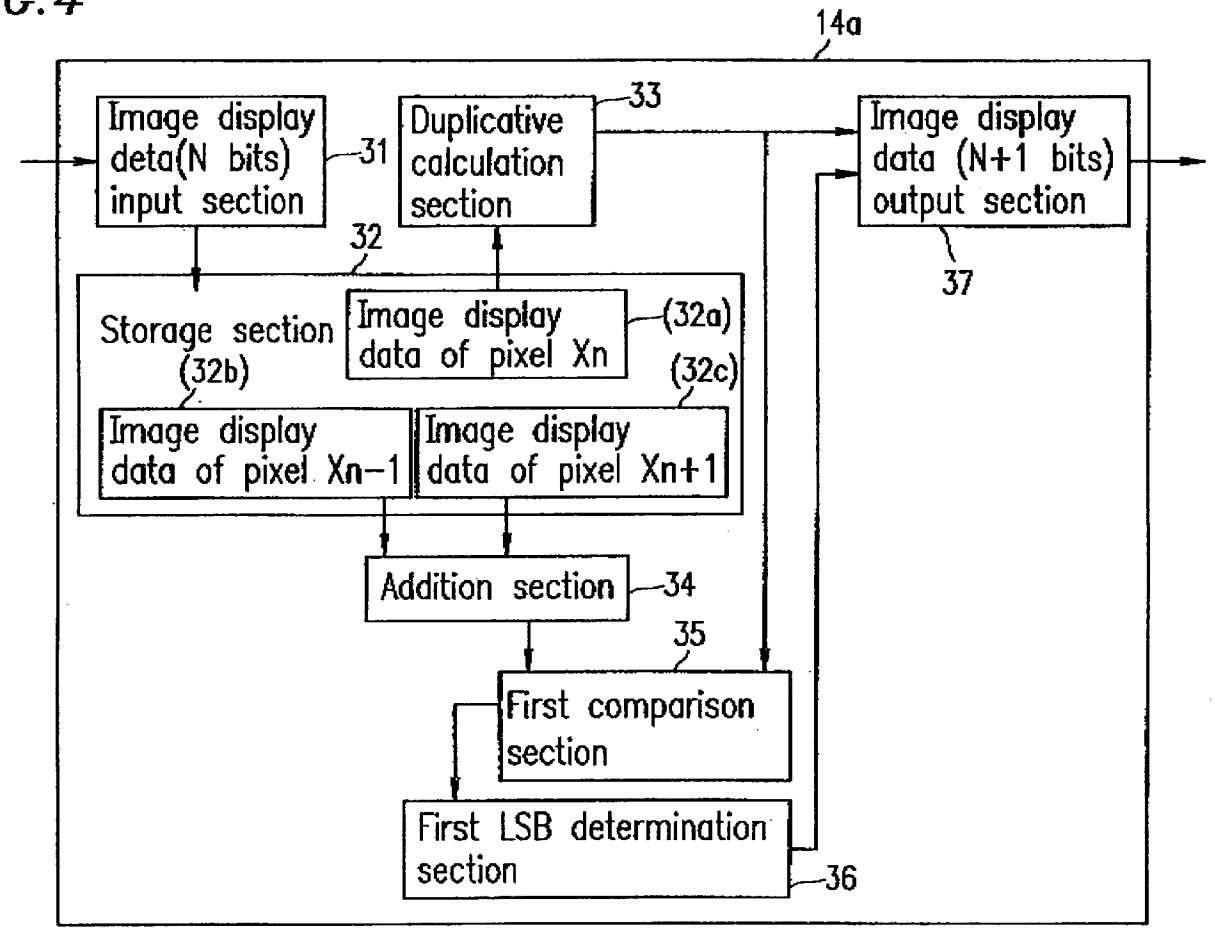
FIG. 4 is a block diagram showing a specific structure of a CDE processing circuit.

Next, a circuit structure used for performing the above CDE processing is described. FIG. 4 is a block diagram showing a specific structure of the CDE processing circuit 14*a*. The CDE processing circuit 14*a* includes an image display data (N bits) input section (color signal input section) 31, a storage section (color signal data storage section) 32, a duplicative calculation section (duplication section) 33, an addition section 34, a first comparison section 35, a first LSB determination section 36, and an image display data (N+1 bits) output section (color signal generation section) 37.

The image display data (N bits) input section 31 inputs an N-bit color signal.

The storage section 32 stores an N-bit color signal. Specifically, the storage section 32 stores a color signal (image display data) corresponding to a certain pixel Xn, a color signal (image display data) corresponding to a certain pixel Xn−1, and a color signal (image display data) corresponding to a certain pixel Xn+1. Thus, the storage section 32 has a storage capacity of at least (N bits×3). In general, image display data is sequentially transferred as serial data. In the duplicative calculation section 33 and the addition section 34, parallel data is processed. Thus, the storage section 32 can be readily realized by a serial-input/parallel-output shift register having a capacity of (N stages×3), or the like.

The duplicative calculation section 33 is a 1-bit shifter circuit which performs a calculation so as to duplicate the color signal of the pixel Xn. In the duplicative calculation section 33, an N-bit image display data is shifted upwardly by 1 bit (N is a natural number), and LSB=0 is newly added to the shifted data, so as to generate an (N+1)-bit image display data, which is a twofold color signal data.

The addition section 34 is an N-bit adder circuit for calculating addition value data by adding the value of the pixel Xn−1 and the value of the pixel Xn+1, which can be realized by known techniques.

The first comparison section 35 performs a calculation so as to obtain a difference between a calculation result of the addition section 34 (addition value data) and a calculation result of the duplicative calculation section 33 (twofold color signal data). The first comparison section 35 is formed by an (N+1)-bit subtraction circuit (A-B).

The first LSB determination section 36 determines the value of the LSB, which is added to the twofold color signal data (a twofold value of the value of the pixel Xn), based on the comparison result of the first comparison section 35. The first LSB determination section 36 is formed by a selection circuit which outputs value "1" or "0" as the LSB based on the comparison result.

The image display data (N+1 bits) output section 37 performs addition of the calculation result of the duplicative calculation section 33 and the LSB determined by the first LSB determination section 36.

The CDE processing circuit 14*a* operates according to the following procedure. In the CDE processing circuit 14*a*, when N-bit image display data is input to the image display data (N bits) input section 31 (color signal input step), current image display data is stored in the storage section 32 (color signal storage step). Image display data stored in the storage section 32 includes the value of the target pixel Xn, the value of the pixel Xn−1, and the value of the pixel Xn+1.

The duplicative calculation section 33 performs a shift calculation on the value of the pixel Xn (5-bit value [Bit4 (MSB), Bit3, Bit2, Bit1, Bit0 (LSB)]) such that the value of the pixel Xn is shifted upwardly by 1 bit, so as to obtain a twofold value of the value of the pixel Xn(6-bit value [Bit5 (MSB), Bit4, Bit3, Bit2, Bit1]) (twofold value calculation step).

The addition section 34 obtains an addition value by addition of the value of the pixel Xn−1 and the value of the pixel Xn+1 (addition value calculation step). The first comparison section 35 obtains a difference value Δ between the calculation value of the addition section 34 and the calculation value of the duplicative calculation section 33 (first comparison step).

If difference value Δ is greater than 0 ($\Delta > 0$), the first LSB determination section 36 outputs 1 as the LSB. If difference value Δ is equal to or smaller than 0 ($\Delta \leqq 0$), the first LSB determination section 36 outputs 0 as the LSB. The image display data (N+1 bits) output section 37 performs addition of the calculation result of the duplicative calculation section 33 and the LSB determined by the first LSB determination section 36, so as to output (N+1)-bit image display data (color signal correction step).

Figures 5A, 5B, 5C:
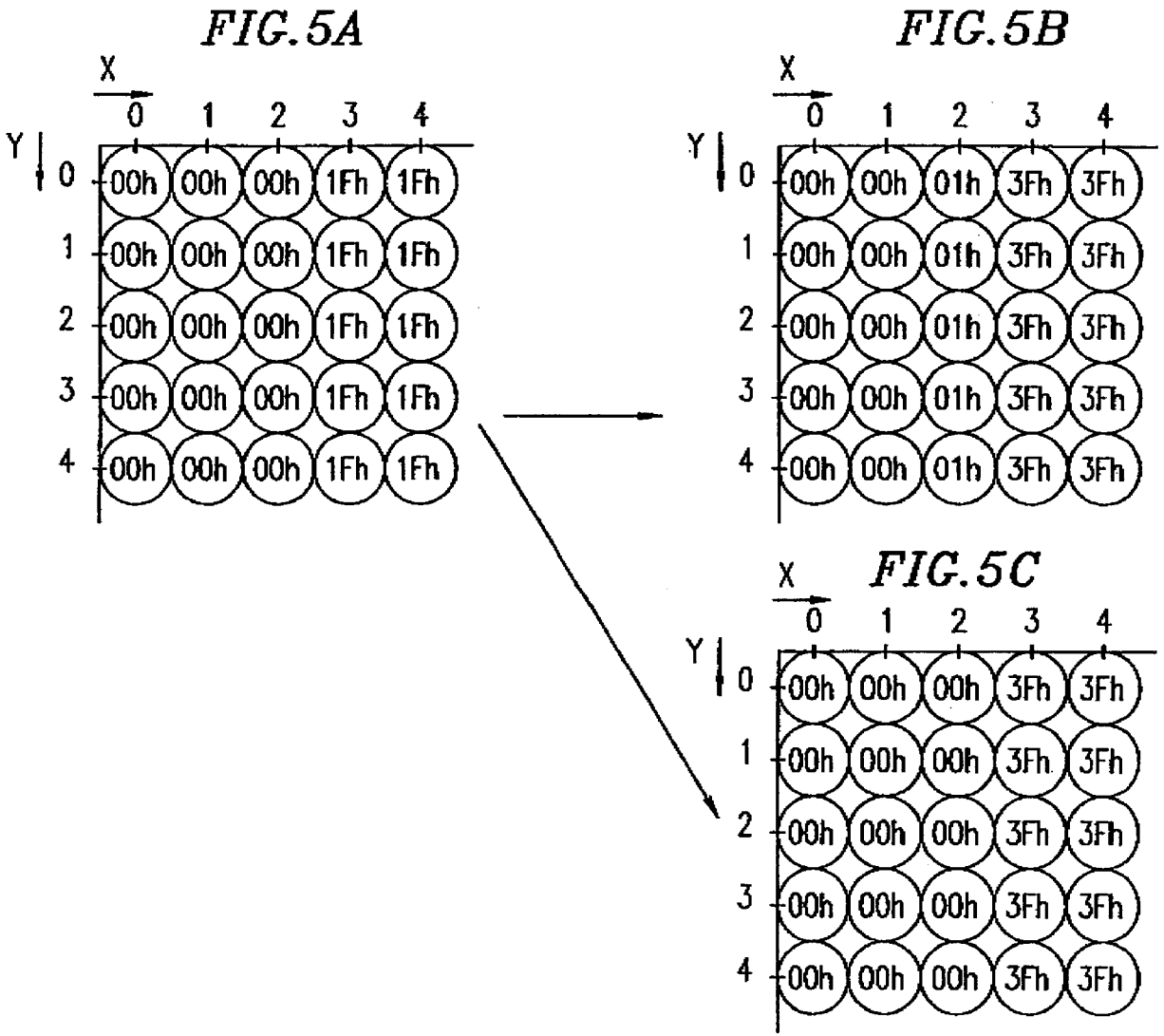
FIG. 5A is a display pattern diagram which includes a portion where the brightness discretely varies.
FIG. 5B is a display pattern diagram obtained when sharpness correction is not performed in CDE processing.
FIG. 5C is a display pattern diagram obtained when sharpness correction is performed in CDE processing.

Next, the principles of CDE processing performed when a color-scale representation in adjoining pixels discretely varies are described. In a general image, the color-scale representation gradually varies in almost all the pixels. However, for example, an image which represents an outline portion of a face or character includes a portion where the brightness varies in a discrete manner. If the above described CDE processing is performed on a portion where there is discrete data, the outline is blurred so that the bright/dark difference (sharpness) of the image is deteriorated. An example of such deterioration is illustrated in FIGS. 5A through 5C. FIG. 5A is a display pattern diagram which includes a portion where the brightness discretely varies. FIG. 5B is a display pattern diagram obtained when sharpness correction is not performed in the CDE processing. FIG. 5C is a display pattern diagram obtained when sharpness correction is performed in the CDE processing.

In FIG. 5A, brightness and darkness can be clearly distinguished between coordinates X=2 and X=3. Such a pattern is sometimes found in a natural image, but such an extreme pattern is typically found in a character display, or the like, Comparing FIGS. 5B and 5C, the value of the pixels at coordinate X=2 is "01h" in FIG. 5B but "00h" in FIG. 5C. This is because, in CDE processing, the above described smoothing processing is performed at a portion where adjoining pixels have gradually varying values. Thus, as shown in FIG. 5B, a certain pixel Xn is influenced by the values of the adjacent pixels Xn−1 and Xn+1 such that the LSB is set to 1 (LSB=1), and accordingly, the value of the pixels at coordinate X=2 becomes "01h". Alternatively, in the case where sharpness correction is performed, the value of the pixels at coordinate X=2 becomes "00h". As a result, the bright/dark difference (sharpness) of the image is not deteriorated.

Figure 6:
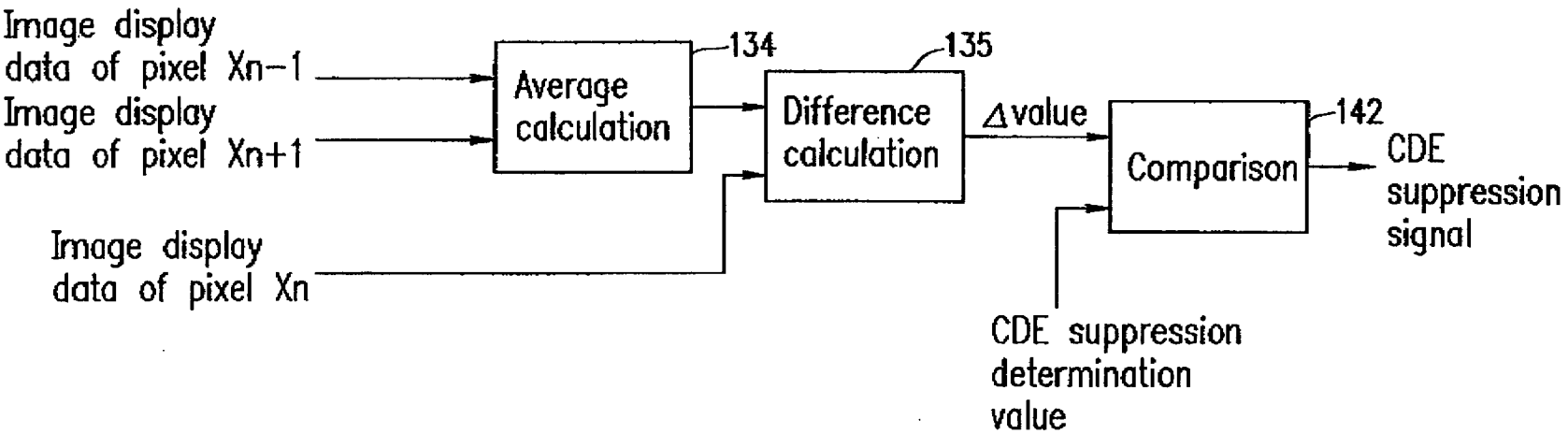
FIG. 6 is a block diagram which illustrates the operation of the mechanism which performs sharpness correction in the CDE processing.

The liquid crystal display apparatus of the present invention is provided with a mechanism for performing sharpness correction in CDE processing on an image where the color-scale representation in the adjoining pixels is discretely varied as illustrated above. FIG. 6 is a block diagram which illustrates the operation of the mechanism which performs sharpness correction in the CDE processing. In order to perform sharpness correction in the CDE processing, the sharpness correction mechanism first calculates a difference value Δ shown above in Expression 1 from the values of the previous and subsequent pixels Xn−1 and Xn+1 of the pixel Xn to be corrected.

In FIG. 6, an average calculation circuit 134 calculates the average value of the previous and subsequent pixels Xn−1 and Xn+1 of the pixel Xn. A difference calculation circuit 135 calculates a difference value Δ between the calculated average value and the value of the pixel Xn to be corrected. A comparison circuit 142 compares the difference value Δ and a CDE suppression determination value, which is previously set by a separate section (described later). If the difference value Δ is equal to or greater than a CDE suppression determination value, the comparison circuit 142 outputs a CDE suppression signal. When the CDE suppression signal is valid, the LSB of the image display data (6 bits) of the pixel to be corrected is fixed to value "0".

On the other hand, if the difference value Δ is smaller than a CDE suppression determination value, the CDE suppression signal output from the comparison circuit 142 is invalidated. In such a case, a value obtained by a method performed by the CDE processing circuit 14 which does not include the above sharpness correction mechanism is employed as the LSB of the image display data (6 bits) of the pixel to be corrected.

Next, a method for obtaining the CDE suppression determination value, which is used in sharpness correction, is described. In order to set the CDE suppression determination value to a value considered to be optimum for the CDE processing, the present inventors used a plurality of measurement objects to perform measurement as described below. First, in this measurement example, a plurality of original images having sufficiently high quality were prepared. Specifically, each of the original images is a natural image (and data) of 24-bit color-scale representation where 8 bits are allocated to each of R-, G-, and B-components. Herein, the "natural image" refers to, for example, an image of a landscape. The number of pixels which represent this natural image is selected from a range of 70,000 to 300,000 pixels, which are used in a liquid crystal display panel.

The image display data of this natural image was once converted into an image format of 16 bits ("5-6-5" format), and then subjected to the CDE processing so as to obtain 18-bit image data (6-bits for each of R-, G-, and B-components). The resultant image data is referred to as a "CDE-corrected image".

On the other hand, the above-generated 16-bit image format data was shifted by 1 bit, and the LSB was set to 0, whereby 18-bit image data was obtained for comparison. This 18-bit image data is referred to as an "uncorrected comparison image". This uncorrected comparison image is equivalent to an image obtained when the LSB fixed method (LSB=0) is employed, and correction based on CDE processing is not performed.

Figure 7:
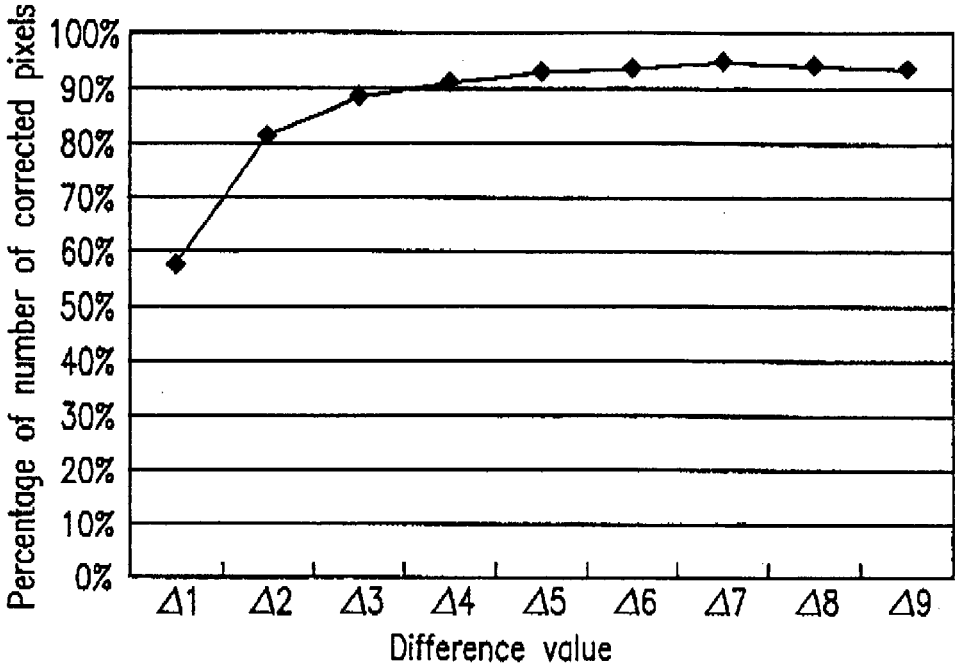
FIG. 7 is a graph showing a relationship between difference values Δ and the percentage of the number of corrected pixels.

Then, the CDE-corrected image and the uncorrected comparison image were compared. It was determined that a pixel of the CDE-corrected image which had image display data (color signal) different from that of a corresponding pixel of the uncorrected comparison image had been subjected to CDE correction. Then, the number of corrected pixels was counted for each or the difference values Δ from 1 to 15. Among these results, the counted numbers for the difference values Δ from 1 to 9 are shown in FIG. 7. FIG. 7 is a graph showing a relationship between the difference values Δ and the percentage of the number of corrected pixels. In FIG. 7, the horizontal axis represents the difference values Δ, and the vertical axis represents the percentage of the number of corrected pixels for each difference value Δ where the percentage of the number of the corrected pixels for difference value Δ of 15 (Δ=15) is 100%. It should be noted that the difference value Δ is a quantized value, i.e., an integer value. However, the points (represented by diamonds) in the graph are connected by straight lines for clarity of illustration.

As seen from FIG. 7, an increase in the number of corrected pixels almost stops at difference value Δ of 7 (Δ=7). Although not shown, after reaching a difference value Δ of 7, the number of corrected pixels was increased only by 0.13% even when correction was performed up to difference value Δ of 15. Further, the above evaluation was performed for a plurality of images, and the trends of evaluation results were substantially the same for all the measured objects. As a result, it was found that a satisfactory image can be obtained when difference value Δ of 7 (Δ=7), where an increase in the number of corrected pixels almost stopped, is selected as the CDE suppression determination value.

This is because the number of pixels corrected by CDE processing does not substantially increase even when the CDE suppression determination value is set to a value larger than 7. Furthermore, since the sharpness correction is performed only when there is a large brightness difference between adjoining pixels, a large CDE suppression determination value raises the operation point of the sharpness correction mechanism. Thus, an unnecessarily large CDE suppression determination value causes a large decrease in the sharpness of an image in CDE processing.

On the other hand, if the CDE suppression determination value is set to an unnecessarily small value, the CDE processing is suppressed even when there is a very small brightness difference between adjoining pixels. Thus, in such a case, sharpness is unnecessarily emphasized even in an image which originally has a smooth color-scale representation, and the quality of the image is deteriorated.

Based on such experiments and considerations as described above, a difference value Δ, where an increase in the number of corrected pixels almost stops, or a difference value Δ in the vicinity of such a difference value Δ, is selected as the CDE suppression determination value. In the above described example, the CDE suppression determination value is set to 7. It should be noted that the CDE suppression determination value does not need to be fixed to a specific value, but may be variable at a desired timing.

Figure 8:
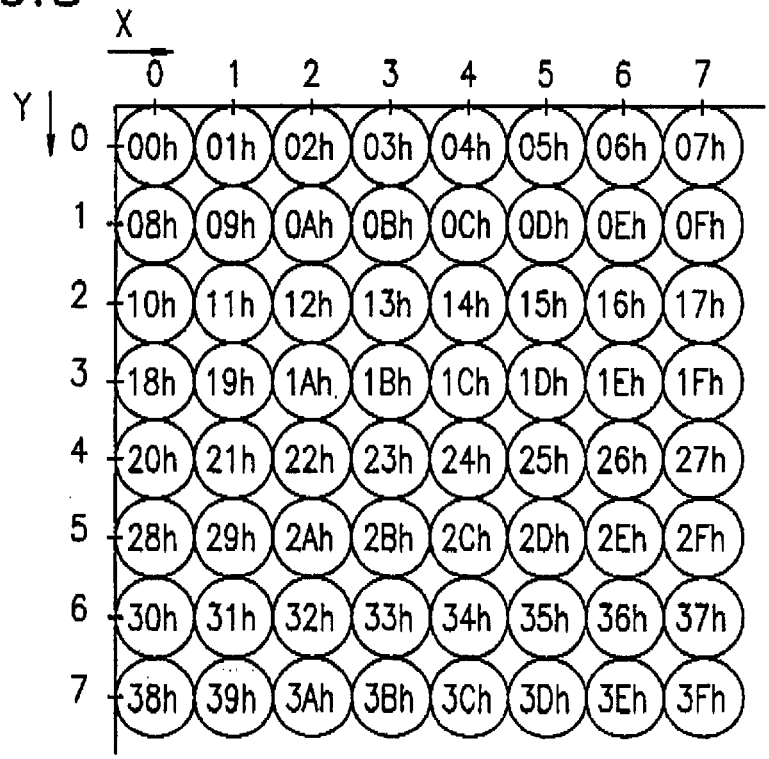
FIG. 8 is a display pattern diagram obtained after color component data (image display data) shown in FIG. 12 has been expanded so as to be 6-bit data.

Based on the above described principles of CDE processing, the expansion conversion process, including sharpness correction, is performed on image display data (5 bits) so as to obtain image display data (6 bits). An example of this expansion conversion process is shown in FIG. 8. FIG. 8 is a display pattern diagram obtained after color component data (image display data) shown in FIG. 12 has been expanded so as to be 6-bit data.

Figure 12:
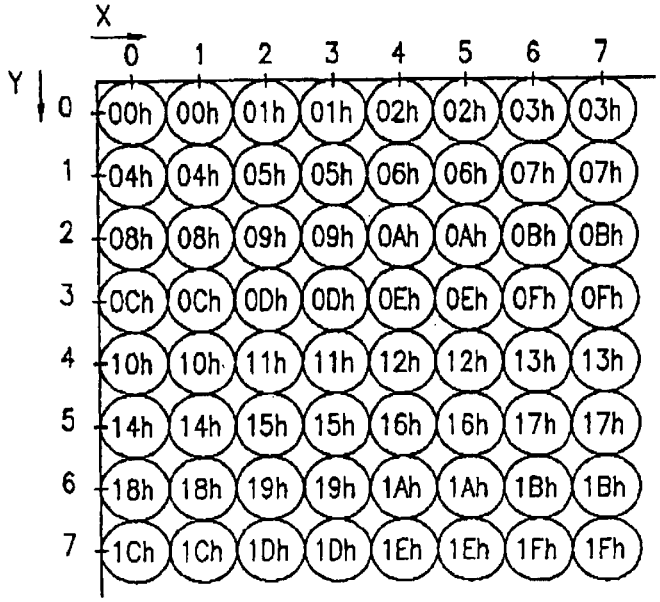
FIG. 12 CONVENTIONAL ART
FIG. 12 shows an example of a display pattern of image display data (original image data) consisting of 5 bits, which is input to a LCDC.
Figure 13:
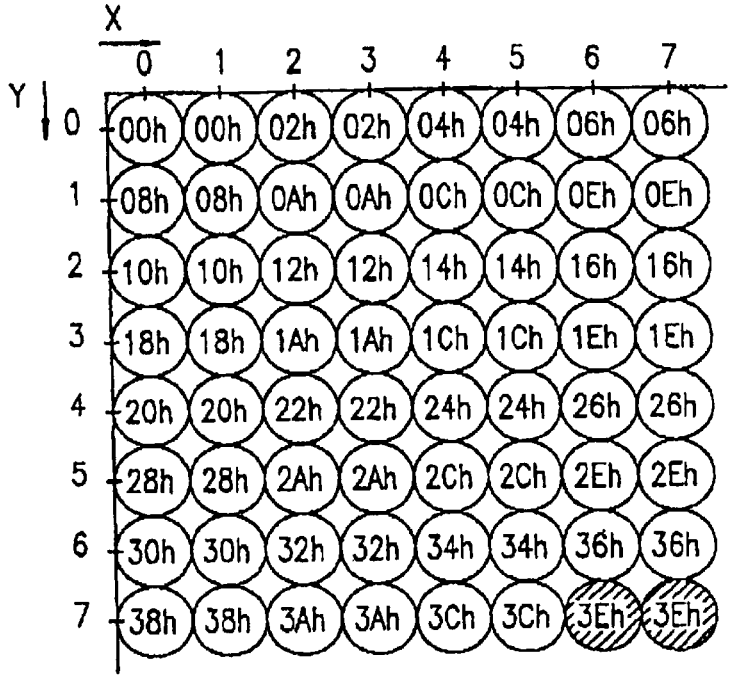
FIG. 13 CONVENTIONAL ART
FIGS. 13 and 14 are display pattern diagrams obtained after the original image data of FIG. 12 has been subjected to color-scale correction based on a LSB fixed method.
Figure 14:
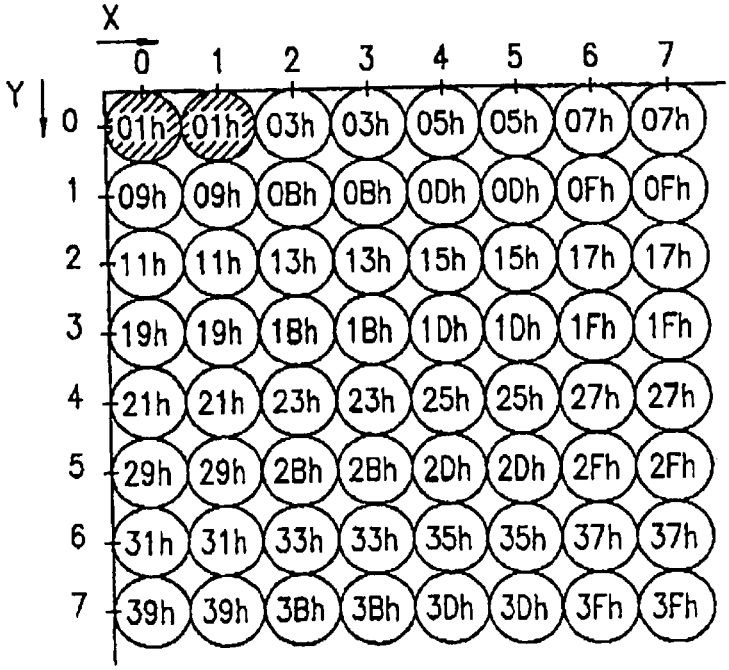
FIG. 14 CONVENTIONAL ART
Figure 15:
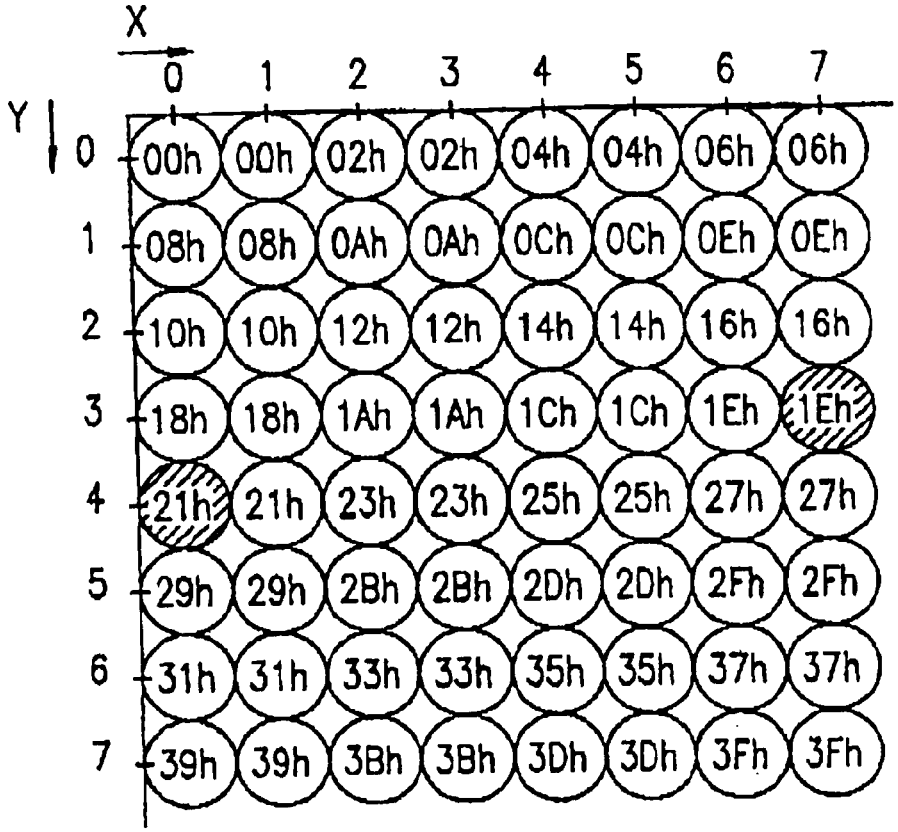
FIG. 15 CONVENTIONAL ART
FIG. 15 is a display pattern diagram obtained after the original image data of FIG. 12 has been subjected to color-scale correction based on an MSB repetition method.
Figures 16A, 16B:
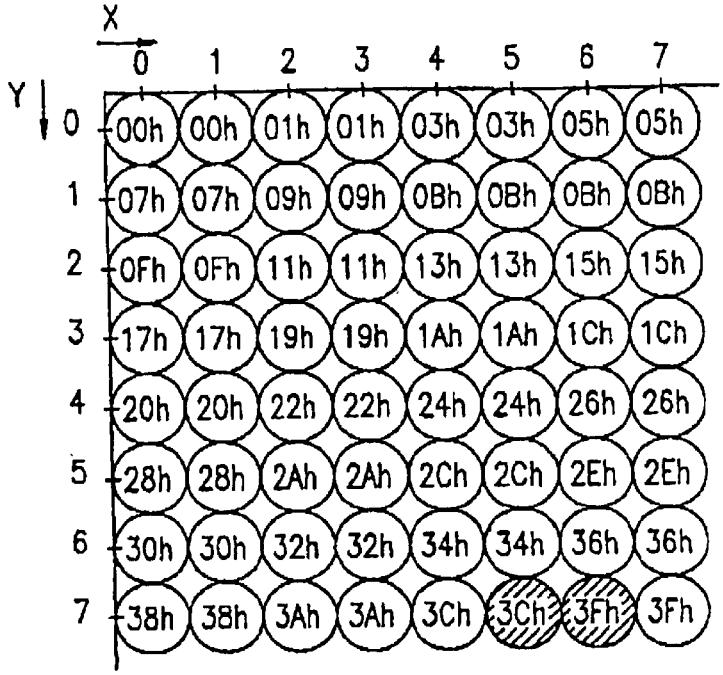
FIG. 16A CONVENTIONAL ART
FIG. 16B CONVENTIONAL ART
FIG. 16A is a display pattern diagram obtained after the original image data of FIG. 12 has been subjected to color-scale correction based on a palette method.
FIG. 16B is an example of a palette.

Color-scale display data of adjoining pixels having consecutive values in FIG. 12 are converted to 6-bit consecutive values as shown in FIG. 15. Thus, a result of the above conversion, i.e., the 6-bit representation shown in FIG. 15 is smoother than the original image data of FIG. 12. The type of data included in the pixels of FIG. 8 include 64 types of data (i.e., 64 color-scale representation) after complementation. Further, "00h (5 bits)" of the original image of FIG. 12 is converted to "00h (6 bits)", and "1Fh (5 bits)" of the original image of FIG. 12 is converted to "3Fh (6 bits)". That is, in this method, the 6-bit color-scale display performance is maximally utilized.

Figure 9:
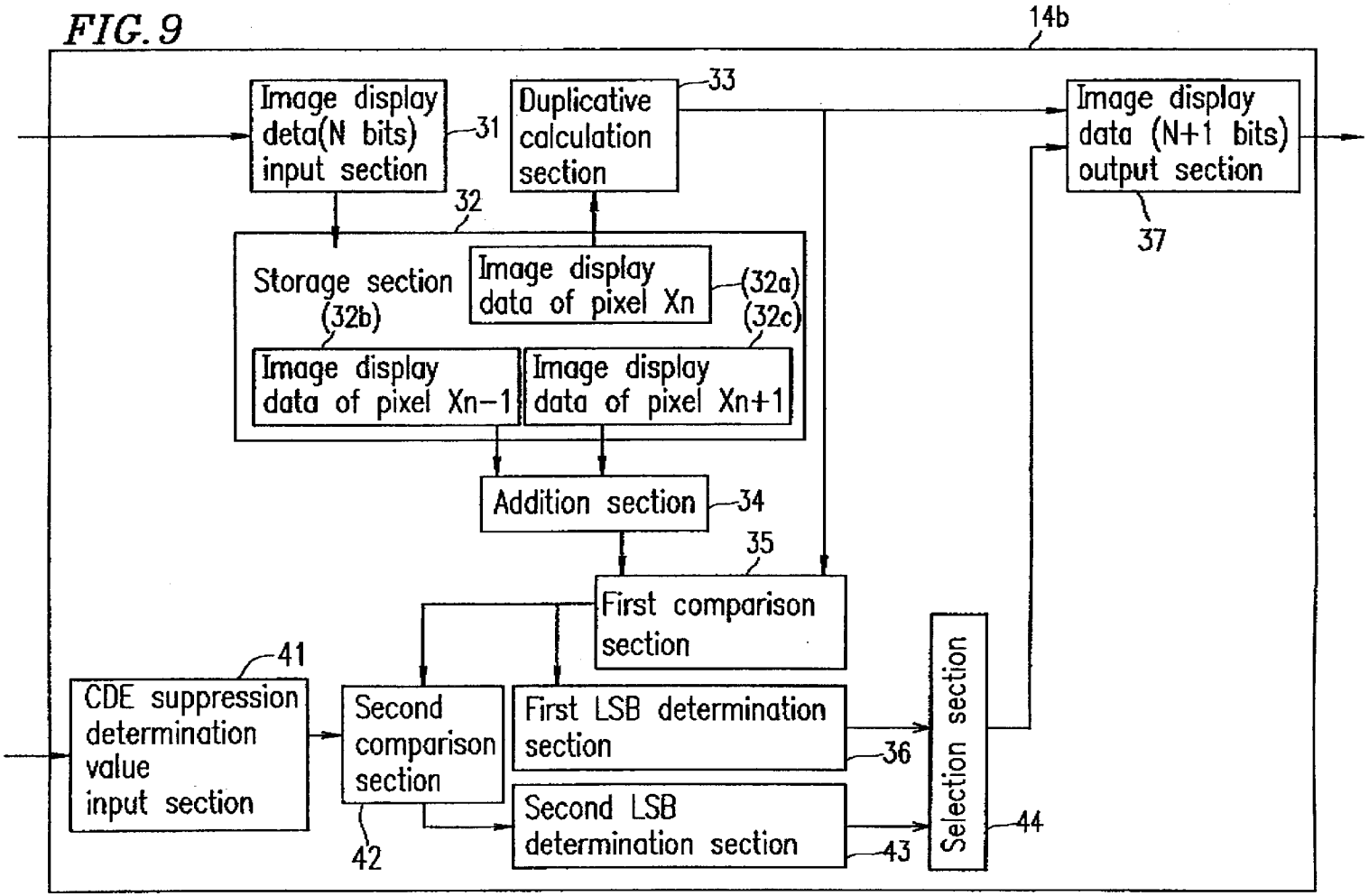
FIG. 9 is a block diagram showing a specific structure of a CDE processing circuit.

Next, a circuit structure used for performing the above CDE processing is described. FIG. 9 is a block diagram showing a specific structure of a CDE processing circuit 14*b*. The CDE processing circuit 14*b* includes the sharpness correction mechanism shown in FIG. 6 in addition to the components of the CDE processing circuit 14*a* shown in FIG. 4. In FIG. 9, like elements are indicated by like reference numerals used in the CDE processing circuit 14*a* of FIG. 4, and detailed descriptions thereof are omitted. It should be noted that, in an actual case, the CDE processing performed by the sharpness correction mechanism of FIG. 6 is performed in the way the CDE processing circuit 14*a* of FIG. 4 performs the CDE processing.

The CDE processing circuit 14*b* includes an image display data (N bits) input section 31, a storage section 32, a duplicative calculation section 33, an addition section 34, a first comparison section 35, a first LSB determination section 36, an image display data (N+1 bits) output section 37, a CDE suppression determination value input section 41, a second comparison section 42, a second LSB determination section 43, and a selection section 44.

The CDE suppression determination value input section 41 is provided to input a CDE suppression determination value. The CDE suppression determination value input section 41 may further have a function of storing a CDE suppression determination value.

The second comparison section 42 compares the comparison result of the first comparison section 35 and a CDE suppression determination value from the CDE suppression determination value input section 41. The second comparison section 42 is formed by a comparator circuit or a 6-bit subtraction circuit (A-B).

The second LSB determination section 43 determines the LSB according to the output of the second comparison section 42. The second LSB determination section 43 is formed by a selection circuit.

The selection section 44 selects one of the LSB determined by the first LSB determination section 36 and the LSB output from the second LSB determination section 43. The selection section 44 is formed by a selection circuit.

Figure 10:
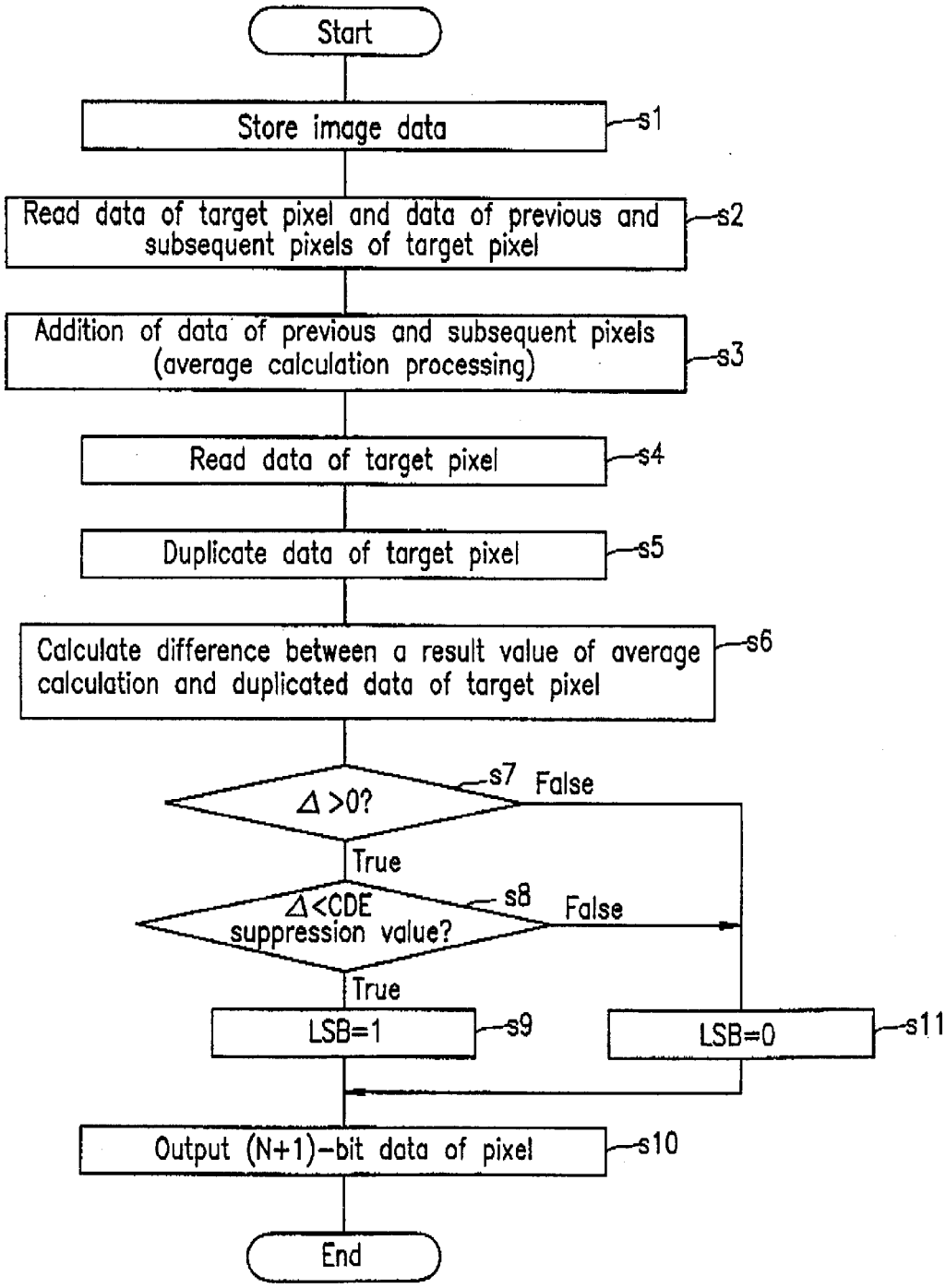
FIG. 10 is a flowchart for illustrating CDE processing.

The processing performed by the CDE processing circuit 14*b* is described with reference to the flowchart of FIG. 10. FIG. 10 is a flowchart for illustrating CDE processing. When a color signal of N bits is input to the image display data (N bits) input section 31 of the CDE processing circuit 14*b* (color signal input step), image display data is sequentially stored in the storage section 32 (color signal storage step). In this storage step, specifically, the image display data of the pixel Xn, and the image display data of the pixels Xn−1 and Xn+1 which are adjacent to the pixel Xn, are stored in the storage section 32 (s1).

Subsequently, the addition section 34 reads out the image display data of the pixels Xn−1 and Xn+1, which are adjacent to the pixel Xn, from the storage section 32 (s2), and performs addition of the read image display data (addition value calculation step: equivalent to average calculation; (s3)). On the other hand, the duplicative calculation section 33 reads out the image display data of the target pixel Xn from the storage section 32 (s4), and shifts the read image display data of N bits by 1 bit so as to obtain image display data of (N+1) bits (twofold value calculation step: equivalent to multiplication by 2; (s5)). At this step, the LSB of the image display data of (N+1) bits is set to 0.

Next, the image display data of (N+1) bits obtained at step s5 is subtracted from the addition data obtained at step s3 to obtain a difference value Δ (first comparison step (s6)). Then, the first comparison section 35 examines the difference value Δ (s7). If the difference value Δ is equal to or smaller than 0, the LSB of the image display data (N+1 bits) of the target pixel Xn is maintained at 0 (first LSB determination step (S11)), and the image display data (N+1 bits) of the target pixel Xn is output (color signal generation step (S10)).

If the difference value Δ is greater than 0, the second comparison section 42 compares the difference value Δ and the CDE suppression determination value (second comparison step (s8)). If the CDE suppression determination value set in a separate section (in this example, "7") is smaller than the difference value Δ at step s8, the image display data (N+1 bits) of the target pixel Xn is corrected by changing the LSB of the image display data from 0 to 1 (second LSB determination step (s9). Then, the image display data (N+1 bits) of the target pixel Xn is output (color signal generation step (s10)).

If the CDE suppression determination value is equal to or greater than the difference value Δ at step s8, the LSB of the image display data (N+1 bits) of the target pixel Xn is maintained at 0 (second LSB determination step (S11)), and the image display data (N+1 bits) of the target pixel Xn is output (color signal generation step (S10)).

In the above process, after CDE processing for the target pixel Xn has been completed, a pixel which is adjacent to the right side of the pixel Xn, i.e., the pixel Xn+1, is selected as a new target pixel, and the above CDE processing is performed on the target pixel Xn+1. Then, after the CDE processing has been performed up to the right most pixel in the same horizontal line, the CDE processing is then performed on pixels in a subsequently underlying horizontal line sequentially from the left most pixel up to the right most pixel.

After CDE processing for the lowest horizontal line of the image has been completed, i.e., CDE processing for one image has been completed, CDE processing is then continuously performed for a next image from the uppermost horizontal line of the image.

In the above described expansion processing where 16-bit image format ("5-6-5" format) data is converted to 18-bit image format data, CDE processing is performed, according to the above described procedure, on the color component data of each of the R-pixel and B-pixel such that the color component data is converted from 5-bit representation to 6-bit representation.

The CDE processing method described above with reference to the flowchart of FIG. 10 is stored as a CDE processing program in the system memory 16 (FIG. 1) of the external host system 8. The CPU 15, which controls the external host system 8, instructs the LCDC 12 to execute the CDE processing program. In such a way, the CDE processing function of the present invention can be realized. The CDE processing program may be stored in, e.g., a recording medium, such as an optical disc 50 (FIG. 1) or the like, and installed from the optical disc 50 to the system memory 16.

In view of the above, the expansion of the color-scale display data by the CDE processing of the present invention is advantageous in comparison to expansion processing of the conventional techniques in the following respects:

(1) Efficient Use of Expanded Bit Width

In the conventional techniques, even when the bit width is expanded, the color resolution of the expanded data is equal to that of unexpanded data. Thus, in the conventional techniques, the expanded bit width cannot be effectively utilized.

In the CDE processing of the present invention, a value of a low-order bit which is lost (rounded down) in unexpanded data is subjected to an arithmetic operation and comparison processing, and restored by estimation. The data expanded by the CDE processing of the present invention includes a larger amount of information than that of the original data. Thus, with such expanded data, image display with a high quality can be realized.

(2) Visually-Smooth Color-Scale Representation

In the conventional techniques, when consecutive color-scale display data is expanded, discrete points whose data values are significantly different are caused in the expanded data. This difference is visually perceived as color unevenness.

In the CDE processing of the present invention, data values are gradually changes in expanded image data. Further, the amount of information in the expanded data is increased as compared with that of unexpanded data as described in above section (1), and accordingly, the color resolution of the image data is increased. In such data, the possibility of color unevenness occurring is decreased.

(3) Color-Scale Representation Which Effectively Utilizes Color Display Performance In some conventional techniques, the brightest value and the darkest value of an original image cannot be reproduced in a converted image. The brightest value and the darkest value are limit values, and therefore can be readily perceived. Thus, in a system using such a conventional technique, color unevenness occurs at the lowest or highest brightness, and the display performance a display device originally has cannot be fully utilized.

In this respect also, the CDE processing of the present invention is advantageous.

(4) Suppression of an Increase in Size of CDE Processing Circuit

The size of the CDE processing circuit of the present invention is relatively small, and thus can be realized on one chip together with the conventional LCDC (liquid crystal driving controller) as shown in FIG. 1. Therefore, an increase in size of a liquid crystal display module and a liquid crystal display apparatus can be suppressed.

The above embodiment of the present invention has been described while considering a liquid crystal display apparatus as an example of the present invention. However, the present invention is not limited to liquid crystal displays. The present invention can be applied to bit expansion of data for color-scale display in the case where a general-purpose CPU system is used as a host system, and the bit width used by the CPU and the color-scale display data length, which is used as a display panel unit, are different. For example, the present invention is applicable to an ELD (electroluminescence display), a PD (plasma display), or the like.

In the above described embodiment of the present invention, image display data of adjoining pixels in the same horizontal line are stored in a storage section, and bit expansion processing is performed while correcting the image display data of the horizontally-adjoining pixels in the same horizontal line of the image. However, as a matter of course, if a display apparatus has a storage section which stores image display data of pixels in the same vertical line (for example, a shift register, or the like), bit expansion processing can be performed the vertically-adjoining pixels in the same horizontal line of the image while correcting the image display data of the vertically-adjoining pixels.

In the case where a storage section for storing image processing data required in calculation processing is provided, CDE processing can be performed on horizontally adjoining pixels, vertically adjoining pixels, or diagonally adjoining pixels, or another combination of pixels. As a result, a more natural image can be readily obtained.

In the above described embodiment of the present invention, linear approximation is performed on a target pixel using image display data of pixels immediately adjacent to the target pixel (two pixels at both sides of the target pixel). However, the present invention is also applicable to curve approximation where image display data of pixels adjacent to the above two adjacent pixels which are immediately adjacent to the target pixel are also used, i.e., image display data of four or more pixels at both sides of the target pixel are used. In such a case, an image more approximate to a natural image can be obtained.

According to the present invention, the following effects can be obtained.

(1) In a color signal correction circuit for correcting a color signal which displays data on each pixel of a display apparatus arranged in a matrix, a color signal data storage section stores a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are included in a color signal of N bits input to a color signal input section. An addition section adds the second color signal and the third color signal to obtain addition value data. A duplication section duplicates the first color signal to obtain duplicated color signal data. A first comparison section subtracts the duplicated color signal data from the addition value data to obtain a difference value. A color signal generation section adds the LSB determined by a first LSB determination section according to the difference value and N higher order bits of the duplicated color signal data, so as to generate a color signal of (N+1) bits. With such a structure, color signal correction is performed on a color component of a color image using a simple circuit so as to obtain a color quality with smooth gradation, whereby the color resolution of the color image can be improved. A value of a low-order bit, which is rounded down in unexpanded data, is subjected to an arithmetic operation and comparison processing, and restored by estimation. As a result, image display with a high quality can be realized.

(2) If the difference value between the addition value data obtained by adding the second and third color signals by the addition means, and the duplicated color signal data obtained by duplicating the first color signal by the duplication section, is equal to or smaller than 0, the first LSB determination section sets the LSB to 0; and if the difference value is greater than 0, the first LSB determination section sets the LSB to 1. With such an arrangement, color signal correction can be performed while achieving high color reproducibility.

(3) In the color signal correction circuit of the present invention, the difference value between the addition value data obtained by adding the second and third color signals by the addition means and the duplicated color signal data obtained by duplicating the first color signal by the duplication section is compared with a predetermined reference value. The second LSB determination section sets the LSB to 0 when the difference value is equal to or greater than the predetermined reference value, and sets the LSB to 1 when the difference value is smaller than the predetermined reference value. With such an arrangement, color signal correction can be performed on an image having a sharp outline without blurring the outline, and the color resolution of the image can be improved.

(4) In the color signal correction circuit of the present invention, a selection section selects one of the LSB determined by the first LSB determination section and the LSB determined by the second LSB determination section. With such an arrangement, the LSB can be selected according to the type of an image on which color signal correction is to be performed.

(5) In the color signal correction circuit of the present invention, the difference value obtained when an increase in the percentage of the number of corrected pixels stops or almost stops is used as the predetermined reference value which is to be compared with the difference value by the second comparison section. With such an arrangement, optimum color signal correction can be performed on various types of images, and the color resolution of the image can be improved.

(6) The predetermined reference value which is to be compared with the difference value by the second comparison section is 7. Thus, even in the case where color signal correction is performed on an image representing an outline portion of a face or character which includes a portion where the brightness varies in a discrete manner, the outline portion is not blurred, and image correction can be performed while maintaining the sharp outline.

(7) A color signal correction apparatus of the present invention includes the color signal correction circuit of any of above paragraphs (1) to (6), wherein at least a correction process is performed on one of a plurality of types of color signals. Thus, there is provided a color signal correction apparatus which performs color signal correction on a color component of a color image using a simple circuit so as to obtain a color quality with no uneven gradation, whereby the color resolution of the color image can be improved.

(8) The plurality of types of color signals include R-, G-, B-signals. Thus, the color resolution of the color image can be improved for each of the color components of the color image.

(9) A color signal is corrected by performing the following steps: a color signal input step of inputting a color signal of N bits (N is a natural number); a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step; an addition value calculation step of adding the second color signal and the third color signal to obtain addition value data; a duplicated value calculation step of duplicating the first color signal to obtain duplicated color signal data; a first comparison step of obtaining a difference value between the addition value data and the duplicated color signal data; a first LSB determination step of determining an LSB according to the comparison result of the first comparison step; and a color signal generation step of adding N higher order bits of the duplicated color signal data and the LSB, so as to generate a color signal of (N+1) bits. Thus, there is provided a method which can perform color signal correction on a color component of a color image so as to obtain a color quality with no uneven gradation, whereby the color resolution of the color image can be improved.

(10) A color signal is corrected by allowing a computer to execute a program including the following steps: a color signal input step of inputting a color signal of N bits (N is a natural number); a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step: an addition value calculation step of adding the second color signal and the third color signal to obtain addition value data; a duplicated value calculation step of duplicating the first color signal to obtain duplicated color signal data; a first comparison step of obtaining a difference value between the addition value data and the duplicated color signal data; a first LSB determination step of determining an LSB according to the comparison result of the first comparison step; and a color signal generation step of adding N higher order bits of the duplicated color signal data and the LSB, so as to generate a color signal of (N+1) bits. Thus, there is provided a color signal correction program which can perform color signal correction on a color component of a color image so as to obtain a color quality with no uneven gradation, whereby the color resolution of the color image can be improved.

(11) A display apparatus of the present invention includes the color signal correction circuit of any of above sections (1) to (6), or the color signal correction apparatus of above section (7) or (8). With such an arrangement, the display apparatus can perform color signal correction on a color component of a color image using a simple circuit so as to obtain a color quality with no uneven gradation, whereby the color resolution of the color image can be improved.

(12) A display apparatus of the present invention includes a control section for executing the color signal correction program of above section (10). With such an arrangement, the display apparatus can execute the color signal correction program to perform color signal correction on a color component of a color image using a simple circuit so as to obtain a color quality with no uneven gradation, whereby the color resolution of the color image can be improved.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A color signal correction circuit for correcting a color signal which displays data on each pixel of a display apparatus arranged in a matrix, comprising:

a color signal input section for inputting a color signal of N bits (N is a natural number);

a color signal data storage section for storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input section;

an addition section for adding the second color signal and the third color signal to obtain addition value data;

a duplication section for duplicating the first color signal to obtain duplicated color signal data;

a first comparison section for subtracting the duplicated color signal data from the addition value data to obtain a difference value;

a first LSB determination section for determining an LSB according to the difference value; and a color signal generation section for adding N higher order bits of the duplicated color signal data and the LSB, so as to generate a color signal of (N+1) bits.

2. A color signal correction circuit according to claim 1, wherein:

if the difference value is equal to or smaller than 0, the first LSB determination section sets the LSB to 0; and if the difference value is greater than 0, the first LSB determination section sets the LSB to 1.

3. A color signal correction circuit according to claim 1, further comprising:

a second comparison section for comparing the difference value with a predetermined reference value, and a second LSB determination section for setting the LSB to 0 when the difference value is equal to or greater than the predetermined reference value, and for setting the LSB to 1 when the difference value is smaller than the predetermined reference value.

4. A color signal correction circuit according to claim 3, further comprising a selection section for selecting one of the LSB determinedly the first LSB determination section and the LSB determined by the second LSB determination section.

5. A color signal correction circuit according to claim 3, wherein the difference value obtained when an increase in the percentage of the number of corrected pixels stops or almost stops is used as the predetermined reference value.

6. A color signal correction circuit according to claim 5, wherein the predetermined reference value is 7.

7. A color signal correction apparatus, comprising the color signal correction circuit of claim 1, wherein in color image data including a plurality of types of color signals, correction is performed on at least one of the plurality of types of color signals.

8. A color signal correction apparatus according to claim 7, wherein the plurality of types of color signals include color signals for R-, G-, B-pixels.

9. A color signal correction method for correcting a color signal which displays data on each pixel of a display apparatus arranged in a matrix, comprising:

a color signal input step of inputting a color signal of N bits (N is a natural number);

a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step;

an addition value calculation step of adding the second color signal and the third color signal to obtain addition value data;

a duplicated value calculation step of duplicating the first color signal to obtain duplicated color signal data;

a first comparison step of obtaining a difference value between the addition value data and the duplicated color signal data;

a first LSB determination step of determining an LSB according to the comparison result of the first comparison step; and a color signal generation step of adding N higher order bits of the duplicated color signal data and the LSB, so as to generate a color signal of (N+1) bits.

10. A color signal correction program for correcting a color signal which displays data on each pixel of a display apparatus arranged in a matrix, the program instructing a computer to execute the following steps:

a color signal input step of inputting a color signal of N bits (N is a natural number);

a color signal data storage step of storing a first color signal corresponding to a predetermined pixel, a second color signal corresponding to a first adjacent pixel which is adjacent to the predetermined pixel, and a third color signal corresponding to a second adjacent pixel which is adjacent to the predetermined pixel at the opposite side with respect to the first adjacent pixel, which are input to the color signal input step;

an addition value calculation step of adding the second color signal and the third color signal to obtain addition value data;

a duplicated value calculation step of duplicating the first color signal to obtain duplicated color signal data;

a first comparison step of obtaining a difference value between the addition value data and the duplicated color signal data;

a first LSB determination step of determining an LSB according to the comparison result of the first comparison step; and a color signal generation step of adding N higher order bits of the duplicated color signal data and the LSB, so as to generate a color signal of (N+1) bits.

11. A display apparatus, comprising the color signal correction circuit of claim 1.

12. A display apparatus, comprising the color signal correction apparatus of claim 7.

13. A display apparatus, comprising a control section for executing the color signal correction program of claim 10.

* * * * *